US007163666B2

(12) United States Patent
Barnes

(10) Patent No.: US 7,163,666 B2
(45) Date of Patent: Jan. 16, 2007

(54) THERMALLY TOLERANT SUPPORT STRUCTURE FOR A CATALYTIC COMBUSTION CATALYST

(75) Inventor: John Barnes, Niskayuna, NY (US)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 630 days.

(21) Appl. No.: 09/992,786

(22) Filed: Nov. 13, 2001

(65) Prior Publication Data

US 2002/0110501 A1 Aug. 15, 2002

Related U.S. Application Data

(60) Provisional application No. 60/248,459, filed on Nov. 13, 2000.

(51) Int. Cl.
*B01J 19/32* (2006.01)

(52) U.S. Cl. ..... 422/311; 422/221

(58) Field of Classification Search ..... 428/586, 428/587, 593, 598; 422/176, 179, 180, 220, 422/222, 221, 311; *B01J 19/32*
See application file for complete search history.

(56) References Cited

U.S. PATENT DOCUMENTS

| | | | | |
|---|---|---|---|---|
| 2,285,944 A | | 6/1942 | Rigby | 431/328 |
| 3,073,685 A | * | 1/1963 | Grove, Jr. et al. | 422/221 |
| 3,135,703 A | | 6/1964 | Sill | 60/227 |
| 3,156,094 A | | 11/1964 | Nash et al. | 60/39.822 |
| 3,889,438 A | * | 6/1975 | Piepers et al. | 52/668 |
| 3,903,396 A | | 9/1975 | Boaz et al. | 219/547 |
| 3,926,565 A | | 12/1975 | Birtigh et al. | 422/179 |
| 3,928,961 A | | 12/1975 | Pfefferle | 60/777 |
| 3,940,923 A | | 3/1976 | Pfefferle | 60/777 |
| 3,993,600 A | | 11/1976 | Hunter | 502/314 |
| 4,072,007 A | | 2/1978 | Sanday | 60/723 |
| 4,134,733 A | | 1/1979 | Völker et al. | 422/177 |
| 4,169,127 A | | 9/1979 | Ashworth et al. | 422/180 |
| 4,285,193 A | | 8/1981 | Shaw et al. | 60/777 |
| 4,301,035 A | | 11/1981 | Risse | 502/256 |
| 4,397,356 A | | 8/1983 | Retallick | 166/303 |

(Continued)

FOREIGN PATENT DOCUMENTS

DE 3926 072 2/1991

(Continued)

OTHER PUBLICATIONS

Patent Abstract of Japan, vol. 8, No. 12, (Jan. 19, 1984) & JP 58-175720 published on Oct. 15, 1983, one page.

(Continued)

*Primary Examiner*—Glenn Caldarola
*Assistant Examiner*—Jennifer A. Leung
(74) *Attorney, Agent, or Firm*—Morrison & Foerster LLP

(57) ABSTRACT

The present invention provides a support structure for a catalyst disposed within an outer containment. Several unique arrangements and connections of supporting struts that form the structure provide a number of significant advantages and improvements. The support structure provides a very low disturbance of gas flow while maintaining a high amount of contact support with catalyst foils. In addition to a high tolerance of thermal gradients and fewer stress concentrations, strong support in radial and axial directions is also provided.

42 Claims, 24 Drawing Sheets

U.S. PATENT DOCUMENTS

| | | | | |
|---|---|---|---|---|
| 4,413,470 | A | 11/1983 | Scheihing et al. | 60/800 |
| 4,864,811 | A | 9/1989 | Pfefferle | 60/777 |
| 4,870,824 | A | 10/1989 | Young et al. | 60/723 |
| 5,183,401 | A | 2/1993 | Dalla Betta et al. | 431/7 |
| 5,232,357 | A | 8/1993 | Dalla Betta et al. | 431/7 |
| 5,248,251 | A | 9/1993 | Dalla Betta et al. | 431/7 |
| 5,250,489 | A | 10/1993 | Dalla Betta et al. | 502/262 |
| 5,258,349 | A | 11/1993 | Dalla Betta et al. | 502/330 |
| 5,259,754 | A | 11/1993 | Dalla Betta et al. | 431/7 |
| 5,342,588 | A * | 8/1994 | Humpolik | 422/311 |
| 5,394,300 | A | 2/1995 | Yoshimura | 361/737 |
| 5,461,864 | A | 10/1995 | Betta et al. | 60/723 |
| 5,505,910 | A | 4/1996 | Nishida et al. | 422/171 |
| 5,511,972 | A | 4/1996 | Dalla Betta et al. | 431/170 |
| 5,512,250 | A | 4/1996 | Betta et al. | 422/173 |
| 5,551,239 | A | 9/1996 | Feeley et al. | 60/723 |
| 5,725,810 | A * | 3/1998 | Brunner et al. | 261/112.2 |
| 6,116,014 | A | 9/2000 | Dalla Betta et al. | 60/777 |
| 6,217,832 | B1 | 4/2001 | Betta et al. | 422/179 |

FOREIGN PATENT DOCUMENTS

| | | | |
|---|---|---|---|
| DE | 195 08 217 | | 9/1996 |
| EP | 0 351 082 | A2 | 1/1990 |
| EP | 0 351 082 | A3 | 1/1990 |
| EP | 0 775 807 | A1 | 5/1997 |
| GB | 2092817 | A * | 8/1982 |
| GB | 2 094 172 | A | 9/1982 |
| JP | 59142332 | | 8/1984 |
| JP | 59225211 | | 12/1984 |
| JP | 2001083812 | | 3/2001 |
| JP | 2001121505 | | 5/2001 |
| JP | 2001147109 | | 5/2001 |
| RU | 2023465 | C1 * | 11/1994 |
| WO | WO 95/ 16516 | A2 | 6/1995 |
| WO | WO 95/ 16516 | A3 | 6/1995 |
| WO | WO 97/47926 | A1 | 12/1997 |

OTHER PUBLICATIONS

Patent Abstract of Japan vol. 17, No. 21, (Jan. 14, 1993), & JP 04-246227 published on Sep. 2, 1992, one page.

* cited by examiner

THERMALLY TOLERANT SUPPORT STRUCTURE FOR A CATALYTIC COMBUSTION CATALYST

CROSS-REFERENCE TO RELATED APPLICATIONS

The present application is related to and claims priority from Provisional Patent Application entitled "Thermal tolerant support structure for a catalytic combustion catalyst", Ser. No. 60/248,459, filed Nov. 13, 2000, and is incorporated in its entirety into the present application herewith.

TECHNICAL FIELD

The present invention relates in general to catalytic converters, and in particular to systems for providing axial support for catalytic converter catalysts.

BACKGROUND OF THE INVENTION

Catalyst structures are employed to promote a variety of high-temperature processes involving reactions such as the partial oxidation of hydrocarbons, the complete oxidation of hydrocarbons for emissions control and efficiency, reactions in catalytic mufflers for automotive emissions control and the catalytic combustion of fuels for further use in gas turbines, furnaces and the like. Generally, catalytic combustion involves mixing fuel and air and passing this mixture through a catalyst structure to effect a combustion reaction. As a result of the combustion process, very high gas temperatures are generated. These high gas temperatures, although favorable for turbine efficiency, subject the catalyst structure to thermal stresses. In addition to thermal stresses, the catalyst structure is also subject to a very high axial force in the direction of gas flow. This axial force arises from the resistance to gas flow created by longitudinally disposed channels of the catalyst structure. Some catalyst structures do not have the intrinsic strength to withstand this axial load and must rely on a catalyst support structure typically located downstream of the catalyst. The support structure is likewise subject to the heavy thermal and mechanical loads that the catalyst structure suffers and must be designed to account for these and other important performance considerations.

Referring now to FIGS. 1 and 2, a typical catalytic combustion reactor 1 is shown in FIG. 1. As shown, a catalyst structure 2 is positioned in a generally cylindrical combustion reactor 1 downstream of a preburner 3 and generally perpendicular to the flow 4 of an oxygen-containing gas. Typically, this gas is an air and fuel mixture, the fuel being introduced to the monolithic catalyst structure 2 via fuel injector 5 and the high velocity air 11 being introduced via a compressor (not shown). The catalyst structure 2 is positioned in this manner to obtain a uniform flow of air/fuel mixture through the catalyst, and to allow the mixture to pass through passageways that extend longitudinally through the catalyst structure 2. In order to maintain the catalyst structure 2 in a stable position in the combustion reactor 1, it is necessary to employ some type of support means or structure to secure the catalyst structure to the combustion reactor, including, as one possibility, a support structure 6 which abuts the outlet side 7 of the catalyst structure 2 to support the axial load on the catalyst. As used herein, the "outlet side" 7 of the catalyst structure 2 is the side where the partially or completely combusted air/fuel mixture exits the catalyst structure 2. Therefore, the "inlet side" 8 of the catalyst structure 2 is the side where the uncombusted air/fuel mixture is initially introduced to the catalyst structure 2. The support structure 6 preferably has a very open structure so that it provides minimal inhibition of gas flow. As shown in FIG. 2, the support structure 6 transfers this axial load to a cylindrical structure 9 via a ledge 10 mounted on the inside of the cylindrical wall or lines 9. Examples of several supporting systems are described in U.S. Pat. No. 5,461,864 to Dalla Betta et al., U.S. Pat. No. 6,116,014 to Dalla Betta et al., and U.S. Pat. No. 6,217,832 to Dalla Betta et al. all incorporated in their entirety herein by reference. The high velocity gas flow 4 in the combustor cylinder 9 generates a significant pressure drop across the catalyst structure 2 and, hence, load upon the catalyst structure 2. It is this load that the support structure 6 must be able to withstand. To understand how this pressure drop is generated, a typical catalyst construction will now be discussed.

A typical catalyst structure 2 can be a corrugated, wound arrangement made up of a multitude of longitudinally disposed channels for the passage of the combustion gas mixture. At least a portion of the channels is coated on their internal surfaces with a combustion catalyst. Examples of typical catalyst structures are found in U.S. Pat. No. 5,250,489 to Dalla Betta et al., U.S. Pat. No. 5,511,972 to Dalla Betta et al., U.S. Pat. No. 5,183,401 to Dalla Betta et al., and U.S. Pat. No. 5,512,250 to Dalla Betta et al., all incorporated in their entirety herein by reference. Generally, corrugated metal foil is coated with a catalyst layer and then spiral wound into a cylindrical structure. Such a catalyst unit has longitudinal channels for gas flow. As gas passes through the unit at high flow rate, the resistance to gas flow through the channels results in an axial load on the catalyst structure 2 that attempts to move the foil in the direction of flow. If the catalyst structure 2 is attached to the combustor at the outer circumference, and if the axial force exceeds the foil to foil sliding frictional resistance in the wound structure, then this axial force will cause the catalyst foils to telescope in the direction of gas flow. The pressure drop across the catalyst structure 2 is typically in the range of 1 to 5 pounds per square inch (psi). For a catalyst system with a diameter of 15 inches, for example, this would result in a force on the catalyst of 180 lbs. at a pressure drop of 1 psi and a force of 900 lbs. at a pressure drop of 5 psi. If a multistage monolithic catalyst structure 2, for example, such as that described in U.S. Pat. No. 5,183,401 to Dalla Betta et al., is employed as a 20-inch diameter catalyst in a catalytic combustion reactor where the air/fuel mixture flow rate is about 50 lbs./second at a pressure drop through the catalyst of 4 psi, the total axial load on the catalyst would be about 1,260 lbs. In essence, the support structure 6 must be able to support a catalyst structure 2 undergoing significant axial forces.

Not only are the axial forces upon the support structure significant, but also, the temperatures within parts of the combustor are very high relative to high performance material strength. The temperature of the catalyst structure can change rapidly while in use and temperatures approaching and even exceeding 1,000° C. are possible. As a result, thermal gradients are quite common in catalytic combustion and a support structure that is designed to withstand a nonuniform temperature is important. A typical operating transient is shown in FIG. 3 where a typical gas turbine system is started up using the combustor system described in FIGS. 1 and 2. FIG. 3 shows the temperature of several components during a start transient. The turbine is started at time 12 by igniting the preburner 3 of combustor in FIG. 1. The average temperature of the gas flowing through the support structure 6 is shown as line 14. The temperature of the cylindrical combustor liner 9 is shown as line 16. As can be seen in FIG. 3, the high temperatures cause the relatively thin-walled, uncooled support structure 6 to thermally expand by a significantly greater magnitude than the relatively thick-walled reaction chamber wall 9 that has a cooler air flowing on one side. As a result, thermal expansion differences between components are generated. To overcome this problem and avoid cracking or deformation of the catalyst structure 2 and support structure 6, the support structure 6 and catalyst structure 2 are generally sized so that their outside diameters are smaller than the inside diameter of the reaction chamber wall 9 to allow thermal expansion of the catalyst structure 2 and support structure 6 during such high temperature operation. If the outside diameter of the support structure is too large, the support structure 6 is unable to thermally expand resulting in possible damage to the support structure 6 itself and to the foils of the catalyst structure 2. Not only are the expansion differences between components problematic, but also, the combination of the large axial loads and high temperatures cause significant deformation of the support structure 6.

For example, FIG. 4 illustrates a sectional view of a catalyst support structure 18 having a monolithic open celled or honeycomb-like structure as described in detail in U.S. Pat. No. 6,116,014 to Della Betta et al. The support structure 18 is formed by thin strips 20 of high temperature resistant metal or ceramic which abut against the outlet side of the catalyst structure 2, and extend in a direction perpendicular to the longitudinal axis of the catalyst structure to essentially cover an outlet side of the catalyst structure 2. The strips 20 making up the support structure 18 are bonded together to form a bonded metal monolith where the contacting flat portions 22 of the strips 20 are joined together by welding or brazing. The bonded metal monolith when exposed to rapidly changing temperature and thermal gradients generates high thermal stresses within the honeycomb structure. Furthermore, the contacting flat portions 22 inhibit independent expansion and contraction of individual strips in response to localized thermal gradients. As a result, stress concentrations at the contacting flat portions 22 may lead to failure of the bonds and cause fatigue, cracking and deformation. Gross failure may lead to failure of the part, a short useful life, and the possible dislocation of a portion of the individual strips 20 resulting in a free body in the system that may threaten turbine integrity downstream. Minimizing the number of joined, redundant structural members increases the freedom of individual axial supports or struts to expand and contract in response to localized thermal-mechanical stresses without imposing stresses on neighboring axial supports or struts. The minimizing of joined, redundant structural members alone or in combination with a construction that allows individual axial supports to expand and contract freely is an important design consideration that has not been addressed by previous inventions. The present invention provides a support structure arrangement having axial supports or struts that are free to expand and contract in response to thermal stresses.

A related design consideration is the facility to which the design lends itself to scalability. To use the honeycomb-like structure discussed above, for example, a support structure having a larger diameter would require a factor of additional welds. A smaller support structure having smaller channels would make welding more cumbersome. This reality associated with either an increase or decrease in size would naturally decrease the ease of manufacture and increase the cost of the support structure. As always, a design that does not substantially increase the cost, time, or difficulty of manufacture with respect to scale is desirable. The present invention sets forth such a support structure design.

Furthermore, a catalyst support structure should minimally obstruct airflow while simultaneously providing uniform support. If struts of the support structure are rather widely spaced over the face of the catalyst, then high local contact forces or stresses will result. In certain portions, these contact forces can exceed the strength of the thin catalyst foil resulting in deformation of the foil under high loads. One solution to this foil deformation problem is to provide more supporting axial supports in order to reduce the contact stress with the catalyst foils at the outlet face of the catalyst. However, an increased number of axial supports will increase the blockage of gas flow and increase the overall pressure drop in the combustor system. In the honeycomb-like design, the support-to-support distance varies widely. For example, at weld locations 22 the strips 22 abut each other and, in effect, provide non-uniform support relative to non-weld locations. Also, the blockage of gas flow is increased at weld locations 22 where there is at least a doubling of strips. This doubling of thickness does not result in uniform support and tends to reduce the efficiency of the gas turbine by decreasing airflow.

Thus, it is desirable to design a support structure that provides the least restriction of air flow through the catalyst, uniform support to the catalyst foils, fewer stress concentrations, and members that are free to expand and contract in response to localized thermal gradients. The present invention is directed at satisfying the aforementioned and additional needs in catalyst support structure construction and design.

SUMMARY OF THE INVENTION

In accordance with one aspect of the invention, there is provided a support structure for being disposed within an outer containment comprising a center, at least two branched segments oriented about the center and encompassed by an outer perimeter. Each branched segment includes a plurality of struts. Each strut has a proximal end and a distal end. The distal end of each strut extends to the perimeter. The proximal end of one strut is connected to the center and each consecutive strut is connected to the previous strut at the proximal end of the consecutive strut such that alternate consecutive struts are substantially parallel to each other.

In accordance with another aspect of the invention, there is provided a support structure comprising a center, at least three branched segments oriented about the center and encompassed by a perimeter. Each branched segment comprises a primary strut having a proximal end and a distal end. The primary strut has an intersection with the center at the proximal end and extends to the perimeter at the distal end. A plurality of secondary struts is also included. Each secondary strut has a proximal end and at least one distal end. Each secondary strut has an intersection with the primary strut at the proximal end of the secondary strut and extends to the perimeter at the distal end of the secondary strut.

In accordance with yet another aspect of the invention, there is provided a support structure comprising a center, an outer ring encompassing the center and a plurality of primary struts. Each primary strut has a proximal end connected to the center and a distal end connected to the outer ring. A plurality of cantilevered struts are also included. Each cantilevered strut has a distal end connected to the outer ring and a proximal end extending towards the center.

In accordance with another aspect of the invention, there is provided a support structure comprising a center, an outer ring encompassing the center, and a plurality of struts configured about the center. Each strut of the plurality of struts has a proximal end and a distal end. Each distal end is connected to the outer ring. A first portion of struts is connected to the center at their proximal ends. At least one strut connected to the outer ring is movably connected at the outer ring such that the distal end of the at least one strut is substantially free to move relative to the outer ring.

In accordance with one aspect of the invention, there is provided a support structure for being disposed within an outer containment. The support structure comprises a center and a plurality of struts configured about the center. Each strut of the plurality of struts has a proximal end and a distal end. Each distal end is connected to the outer containment. A first portion of struts is connected to the center at their proximal ends. At least one of the struts connected to the outer containment is movably connected to the outer containment such that the distal end of the at least one strut is substantially free to move relative to the outer containment.

A support structure comprising a center and a plurality of struts configured about the center. Each strut of the plurality of struts has a proximal end and a distal end. A first portion of struts is connected to the center at their proximal ends. A second portion of struts is also included. Each strut of the second portion is connected to another strut at its proximal end. At least one strut of the first portion is connected such that its proximal end is substantially free to move relative to the center. At least one strut of the second portion is connected such that its proximal end is free to move relative to the another strut.

In accordance with another aspect of the invention, there is provided a support structure for a catalyst comprising a center, a plurality of struts configured into branched segments about the center. The distance between adjacent struts provides a substantially uniform contact stress with respect to a substantial portion of the catalyst.

In accordance with another aspect of the invention, there is provided a support structure comprising a center and a plurality of struts. Each strut has a proximal end and a distal end. The plurality of struts is configured about the center such that each strut is substantially free to expand or to contract at its distal end or proximal end as temperature changes.

In accordance with another aspect of the invention, there is provided a support structure comprising a center, an outer perimeter encompassing the center and a plurality of struts forming at least two branched segments oriented about the center. Each branched segment includes a first strut having a proximal end and a distal end. The proximal end of the first strut is connected to the center and extends to the perimeter at its distal end. The branched segment also includes at least a second strut having a proximal end and a distal end. The proximal end of the second strut is connected to the first strut and extends to the perimeter at its distal end.

BRIEF DESCRIPTION OF THE DRAWINGS

The foregoing and other advantages of the invention will become apparent upon reading the following detailed description and upon reference to the drawings in which.

Figure 1:
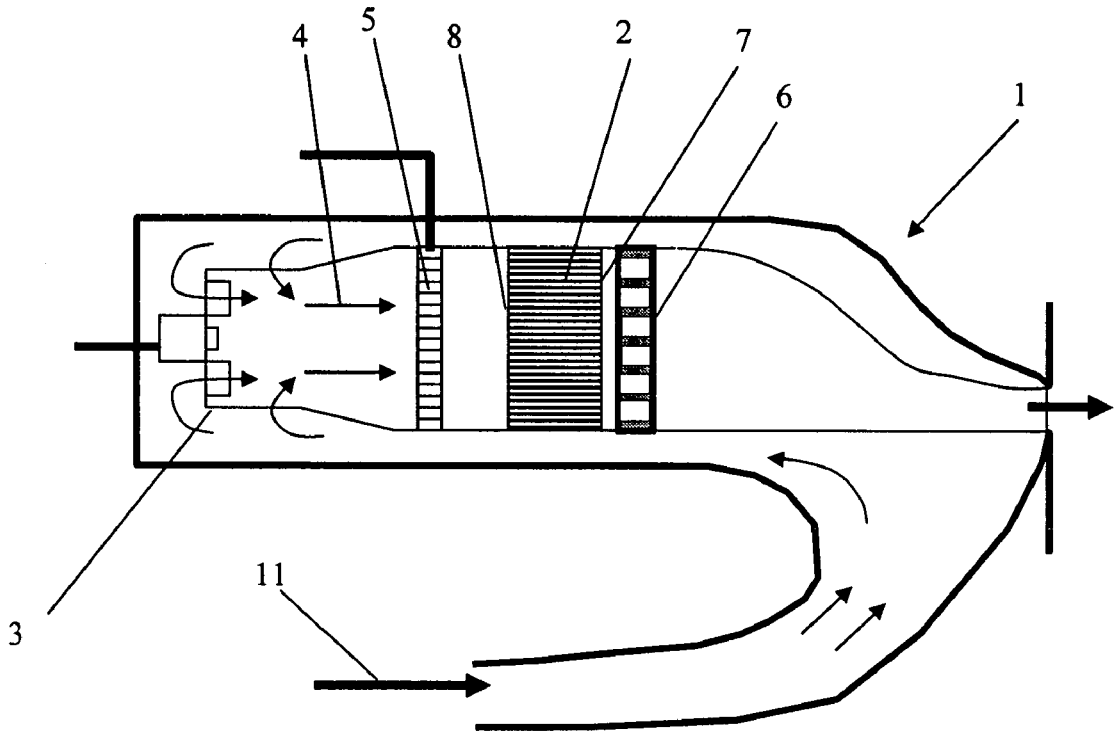
Fig 1 (PRIOR ART)
FIG. 1 is a schematic view of a catalytic combustion reactor.

While the invention is susceptible to various modifications and alternative forms, specific variations have been shown by way of example in the drawings and will be described herein. However, it should be understood that the invention is not limited to the particular forms disclosed. Rather, the invention is to cover all modifications, equivalents, and alternatives falling within the spirit and scope of the invention as defined by the appended claims.

DESCRIPTION OF THE SPECIFIC EMBODIMENTS

The present invention provides an axial support structure for a catalyst consisting of rectangular shaped bars or struts arranged in a modified radial fashion so that all of the struts are free to thermally expand and contract as the temperature changes. In accordance with the present invention, a unique arrangement of supporting struts forms a support structure that restrains the outlet side of the catalyst unit.

Figure 5:
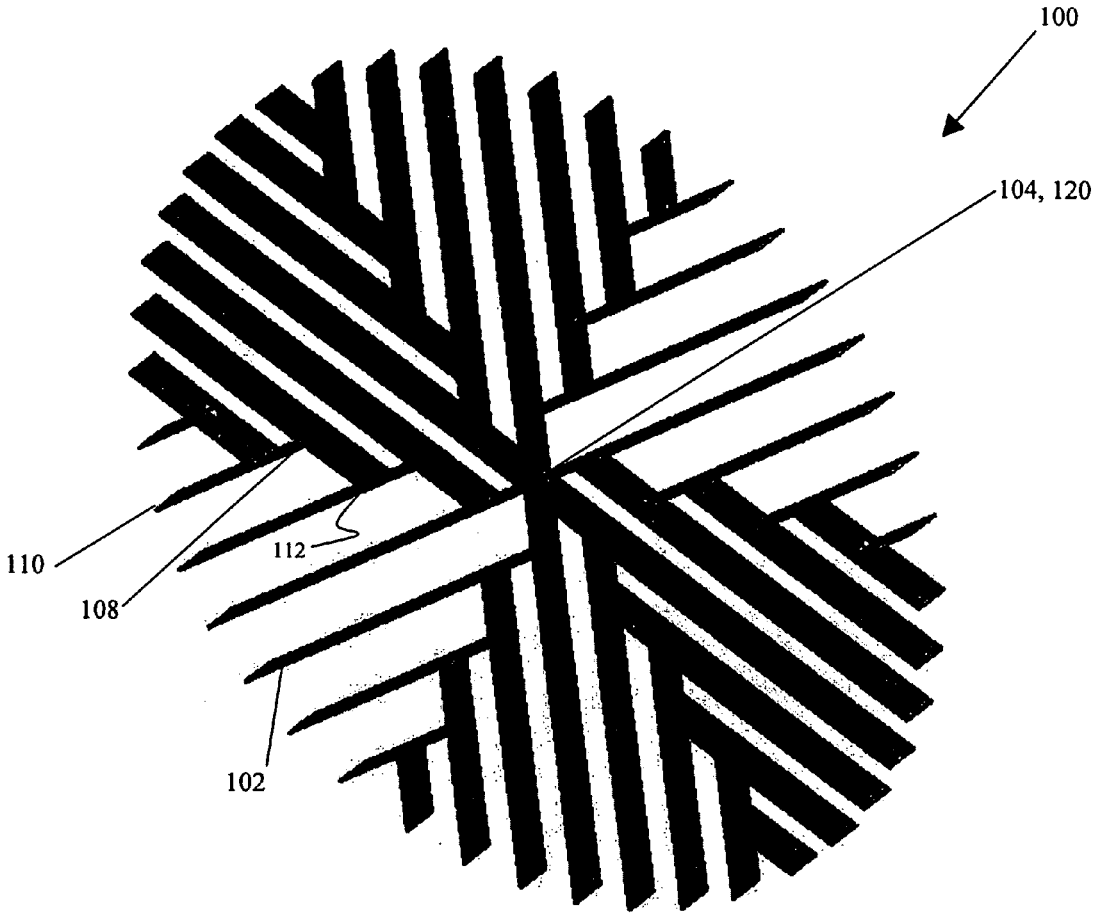
FIG. 5 is a perspective view of a support structure of the present invention.
Figure 6A:
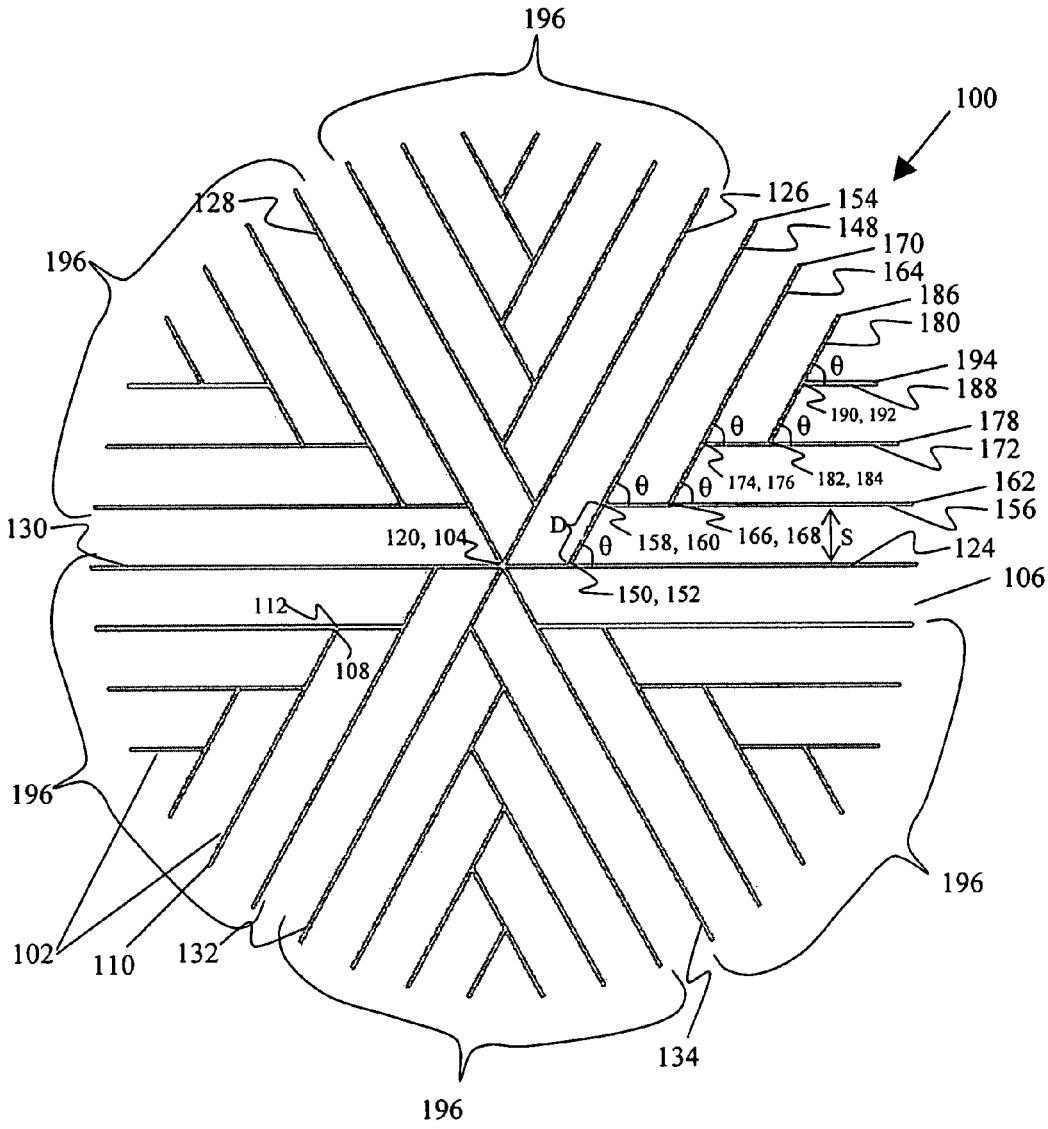
FIG. 6A is a view along an axial direction of a support structure of the present invention.

A representative example of a catalyst support structure 100 is shown in FIGS. 5 and 6*a*. The support structure 100 includes a plurality of struts 102 configured about a center 104. An outer perimeter 106 is depicted by a dotted line in FIG. 6*a*. Each strut 102 includes a proximal end 108 and a distal end 110. The proximal end 108 0f each strut 102 is located proximally to the center 104 relative to the distal end 110, which is located proximally to the perimeter 106. The proximal end 108 of each strut 102 locates an intersection 112 with another strut or struts 102 and the distal end 110 of each strut 102 extends towards the perimeter 106.

Figure 6B:
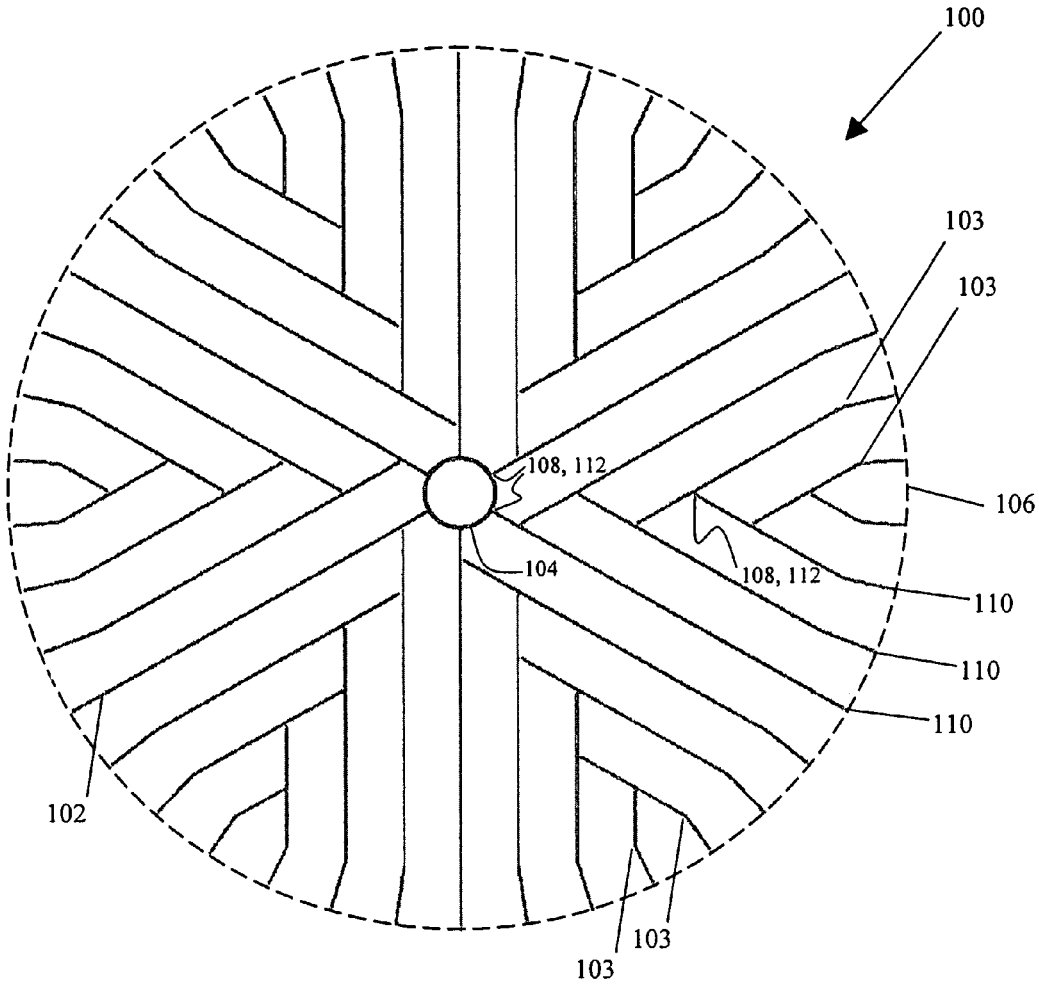
FIG. 6B is a view along an axial direction of a support structure of the present invention.

In one variation, shown in FIG. 6*b*, struts 102 are bent to form an elbow 103 such that their distal ends 110 are substantially perpendicular to the perimeter 106. Not all struts 102 need to include an elbow 103. For example, struts 102 that are substantially radial are already substantially perpendicular. At least one strut in this variation includes an elbow 103.

Although the perimeter 106 in FIG. 6*a* is circular in shape, the invention is not so limited and any shape can be defined by the perimeter 106. Generally, the perimeter 106 is selected to coincide substantially with the cross-sectional shape of the combustor (not shown) in which the support structure 100 resides. The perimeter 106 encompasses the plurality of struts 102 to define an area 113.

Figure 7:
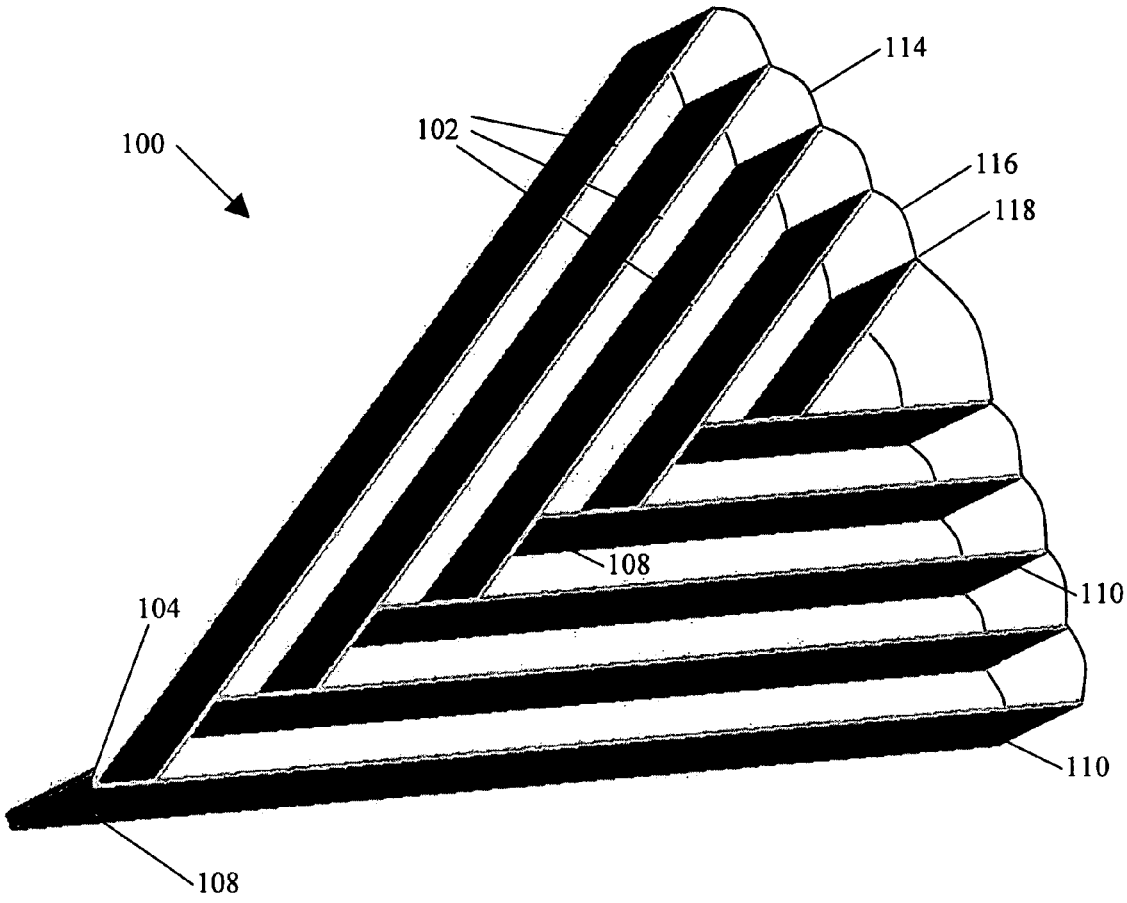
FIG. 7 is a perspective view of a portion of a support structure of the present invention.

In one variation depicted in FIG. 7, an outer ring 114 is located at the perimeter 106. In such a variation, the distal ends 110 of at least some struts 102 are coupled to the outer ring 114. In addition to welding, brazing, bolting, pinning, or riveting, struts 102 can be coupled to the outer ring 114 by employing novel constructions described below. The outer ring 114 that is shown in FIG. 7 is corrugated to include a series of alternating peaks 116 and troughs 118. Struts 102 are connected to the outer ring 114 at the troughs 118 so that a moving or thermally expanding or contracting strut will flex the outer ring 114 at the location of a trough 118 to which it is connected. This movement or thermal expansion or contraction of struts can flex the outer ring 114 permitting freedom of movement with decreased stress formation. Of course, the outer ring 114 permits struts to expand individually.

Figure 8:
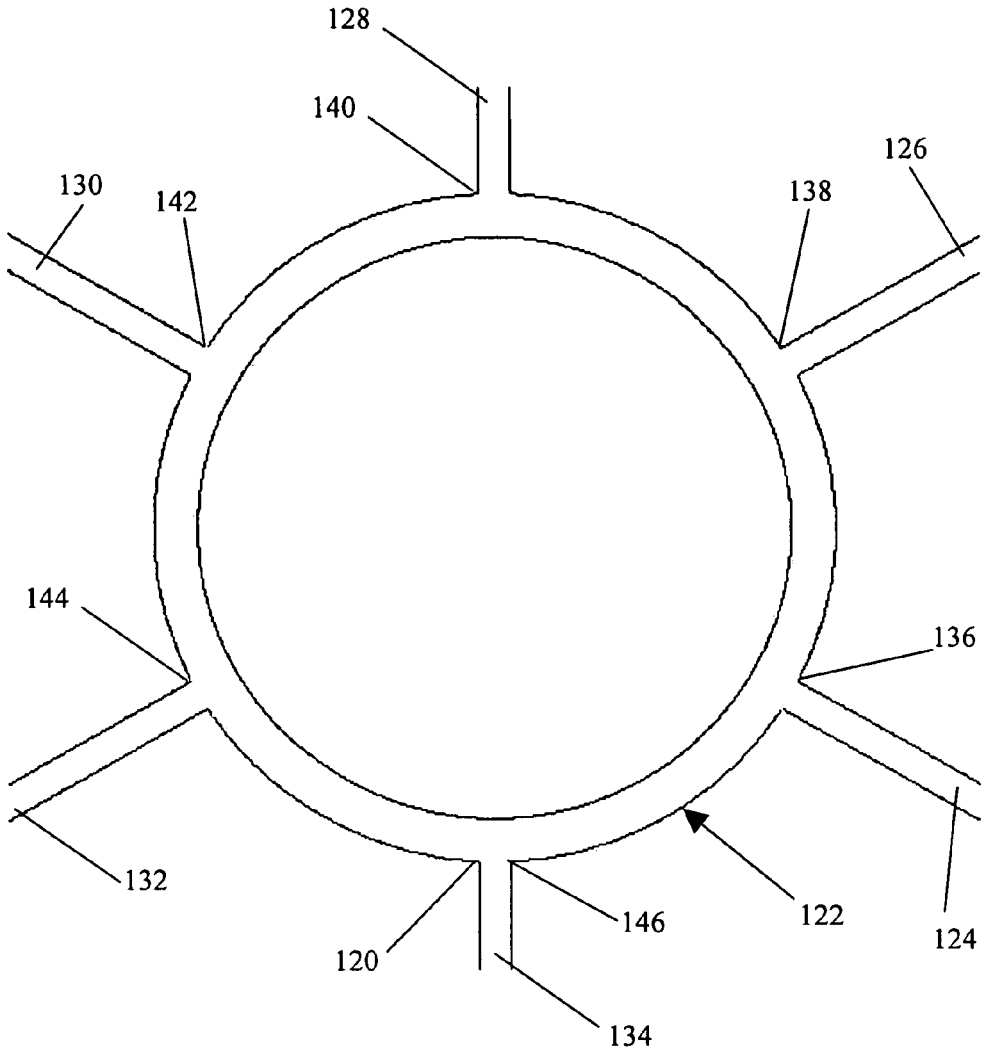
FIG. 8 is a sectional view along an axial direction of a portion of the support structure of the present invention.

The center 104 constitutes a singular intersection 120 as shown in FIGS. 5 and 6*a*. However, as illustrated in FIG. 8, the invention is not so limited and the center 104 may constitute a hub 122 having a cross-sectional shape that is circular and that supports a plurality of intersections 120. Of course, the shape of the hub 122 is not limited to the circular shape and any shape can be employed. The hub 122 can optionally be attached to a center spindle (not shown) to transfer axial load upstream to a second support structure. In addition, the overall shape of the support structure 100 may not be circular. The center 104 is not necessarily coincident with the geometric center of the support structure. The center is a central intersection or hub that may or may not be at the geometric center of the support structure.

Focusing now on FIGS. 6*a* and 8, the arrangement of struts 102 will now be described in detail. In the arrangement of the plurality of struts 102 of the support structure 100, a long or primary strut 124 is joined with similar primary struts 126, 128, 130, 132 and 134 at a single intersection 120 that coincides with the center 104 as shown in FIG. 6. Alternatively, as shown in FIG. 8, primary struts 124, 126, 128, 130, 132 and 134 are joined at separate intersections 136, 138, 140, 142, 144 and 146, respectively, located on the hub 122. In either case, the primary struts 124, 126, 128, 130, 132 and 134 extend from an intersection 120 at their proximal ends towards the perimeter 106 at their distal ends. The struts may meet the perimeter at their distal ends. The primary struts 124, 126, 128, 130, 132 and 134 are straight and, preferably, radial with respect to the center 104. Alternatively, the primary strut is not radial but slightly offset from radial. Also, the primary strut need not be straight but can be curved or corrugated for example, or have at least one angle.

Shorter or secondary strut 148 is attached to primary strut 124 at intersection 150 at its proximal end 152 and extends to the perimeter 106 at its distal end 154. Secondary strut 148 is shorter relative to strut 124 and is attached at an angle θ with respect to primary strut 124. Secondary strut 156 is shorter relative to secondary strut 148 and is attached to secondary strut 148 at intersection 158 at a proximal end 160 of secondary strut 156 and extends to the perimeter 106 at its distal end 162. Secondary strut 156 is attached at an angle θ with respect to secondary strut 148 such that it is substantially parallel to strut 124 being substantially equally spaced a distance S. Secondary strut 164 is shorter relative to strut 156 and is attached to strut 156 at intersection 166 at a proximal end 168 of strut 164 and extends to the perimeter 106 at its distal end 170. Strut 164 is attached at an angle θ with respect to secondary strut 156 such that it is substantially parallel to strut 148 being substantially equally spaced a distance S. Secondary strut 172 is shorter relative to strut 164 and is attached to strut 164 at intersection 174 at a proximal end 176 of strut 172 and extends to the perimeter 106 at its distal end 178. Strut 172 is attached at an angle θ such that it is substantially parallel to struts 124, 156 being substantially equally spaced a distance S from strut 156. Secondary strut 180 is shorter relative to strut 172 and is attached to strut 172 at intersection 182 at a proximal end 184 of strut 180 and extends to the perimeter 106 at its distal end 186. Strut 180 is attached at an angle θ such that it is substantially parallel to struts 148, 164, being substantially equally spaced a distance S. Secondary strut 188 is shorter relative to strut 180 and is attached to strut 180 at intersection 190 at a proximal end 192 of strut 188 and extends to the perimeter 106 at its distal end 194. Strut 188 is attached at an angle θ such that it is substantially parallel to struts 124, 156, 172, being substantially equally spaced a distance S. This arrangement can be repeated to incorporate a preselected number of struts given variable design parameters such as, for example, the diameter of the support structure and distance S.

By branching the primary struts while moving away from the center 104, the distance S between the struts is selected to be substantially constant. This provides for a nearly constant span of the catalyst foils between the struts and therefore a constant force between the catalyst foils and each strut. The contact stress between the catalyst and the edge of each strut can be adjusted by proper design, specifically by analytically selecting the separation between the struts, the thickness of the strut and the thickness of the catalyst foil. The strut thickness is preferably selected to not significantly restrict the local flow at the contact location and to have smooth flow at the downstream strut edge. Also, the present geometric arrangement can advantageously be increased to any diameter without increased contact stress at the outmost circumference or the blockage near the central intersection As can be seen in FIG. 6*a*, the arrangement described above forms a branched segment 196 that stems from each primary strut 124, 126, 128, 130, 132 and 134. In sum, the arrangement of each branched segment 196 involves a primary strut and a plurality of secondary struts wherein the primary strut is connected to the center at its proximal end and extends to the perimeter at its distal end and wherein each consecutive secondary strut is connected to the previous strut such that the proximal end of each consecutive secondary strut is connected to the previous strut at angle θ and a distance, D from the proximal end of the previous strut and angle θ such that alternate struts are substantially parallel to each other being separated by a distance S and such that the distal ends of all struts extend to the perimeter. In effect, two sets of parallel struts are formed per branched segment 196. FIG. 6*a* depicts six primary struts 124, 126, 128, 130, 132, and 134 and an equal number of branched segments 192 oriented about the center 104. However, not all primary struts need to carry secondary struts as will be made clear below with respect to another variation for the support structure.

Figure 9:
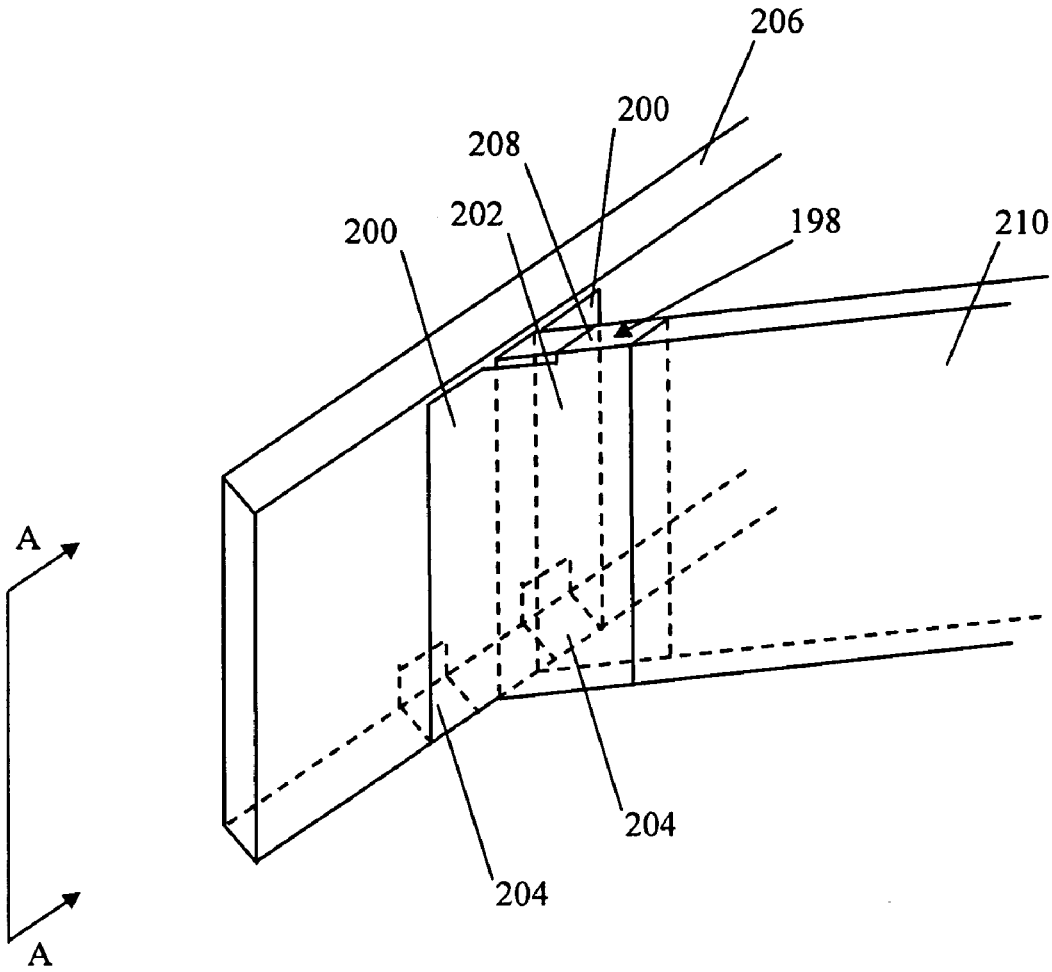
FIG. 9 perspective view of a braze lug and strut connection of the present invention.

Struts are coupled at intersections by welding, brazing, bolting, pinning, or riveting. In one variation braze lugs are employed. FIG. 9 illustrates a braze lug 198. The braze lug 189 is preferably formed from one piece of thin metal sheet made of a similar metal alloy as the struts or of any material with appropriate properties of strength, formability, brazing properties, etc. The braze lug 198 includes two flanges 200 that dovetail to form a strut-receiving portion 202. Two tabs 204 that are adapted to be folded around a strut 206 to which the braze lug 198 is attached are also included. At least one additional tab 208 is included to further secure a strut 210 received within braze lug 198. The braze lug 198 may be tack welded to the strut 206 to which it is attached. A strut 210 is then inserted into the strut-receiving portion 202 of the braze lug 198 and then the structure is brazed in a furnace at high temperature to set the struts in place. Although referred to as braze lugs 198, it is clear that their use is not reserved for brazing alone. In one variation, a strut that is inserted into the strut-receiving portion 202 is free to expand and contract in response to thermal mechanical stresses.

Figure 10:
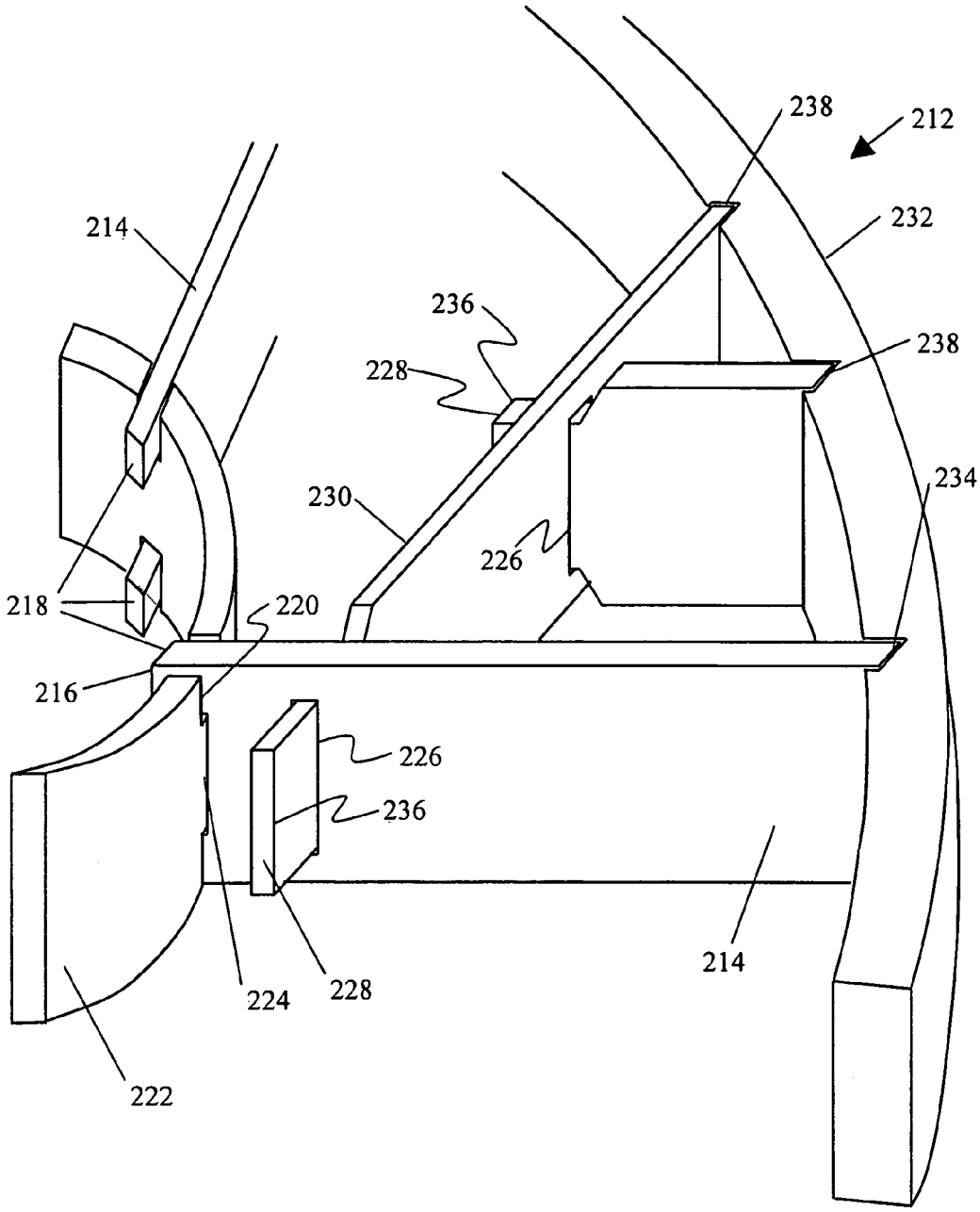
FIG. 10 is a perspective view of a portion of a support structure employing slip joints of the present invention.

Alternatively, as shown in FIG. 10, struts are connected with slip joints. Of course, any combination of welding, brazing, pinning, bolting, riveting and slip joints can be employed. Eliminating welds through the use of slip joints increases the freedom of strut movement arising from axial loading and from thermal expansion and contraction. Slip joints also reduce stress concentrations. Referring to FIG. 10, an exemplary sectional view of a support structure 212 illustrating the use of slip joints is shown. Generally, a primary strut 214 at its proximal end 216 includes at least one tongue 218 for mating with at least one slot 220 formed in a hub 222. As shown, the primary strut 214 includes two tongues 218 that are received in two slots 220 correspondingly formed at locations in the hub 222. The hub 222 is shown to further include at least one projection 224 located on at least one side of the primary strut 214 to prevent lateral movement of the primary strut 214. Slip joints enable the primary strut 214 to substantially expand or contract relative to the hub 222. The primary strut 214 also includes a slot 226 for receiving a tongue 228 of a consecutive secondary strut 230. The primary strut 214 is coupled to an outer ring 232 at a distal end 234 by welding, brazing, or dovetailing into the outer ring 232. Details of various novel connections with the outer ring 232 are described below and may also be employed. The primary strut 214 may also include at least one projection (not shown) to help secure the secondary struts.

Secondary struts 230 include at least one tongue 228 located at a proximal end 236 of the secondary strut 230 and a slot 226 adapted to receive the tongue 228 of a consecutive secondary strut 230. The slot 226 on a secondary strut 230 is located between the proximal end 236 and a distal end 238 of the secondary strut 230. The distal end 238 of the secondary strut 230 is coupled to the outer ring 232. The last of consecutive secondary struts 230 does not have a slot 226. Tongues and slots of secondary and primary struts are sized to prevent dislocation of the strut and to prevent a moving or an expanding strut from impinging upon a strut or outer ring to which it is coupled while securing all struts in place. Slip joints, such as the tongue and groove, enable a secondary strut to substantially move, expand or contract relative to the secondary strut to which it is connected.

Figure 11A:
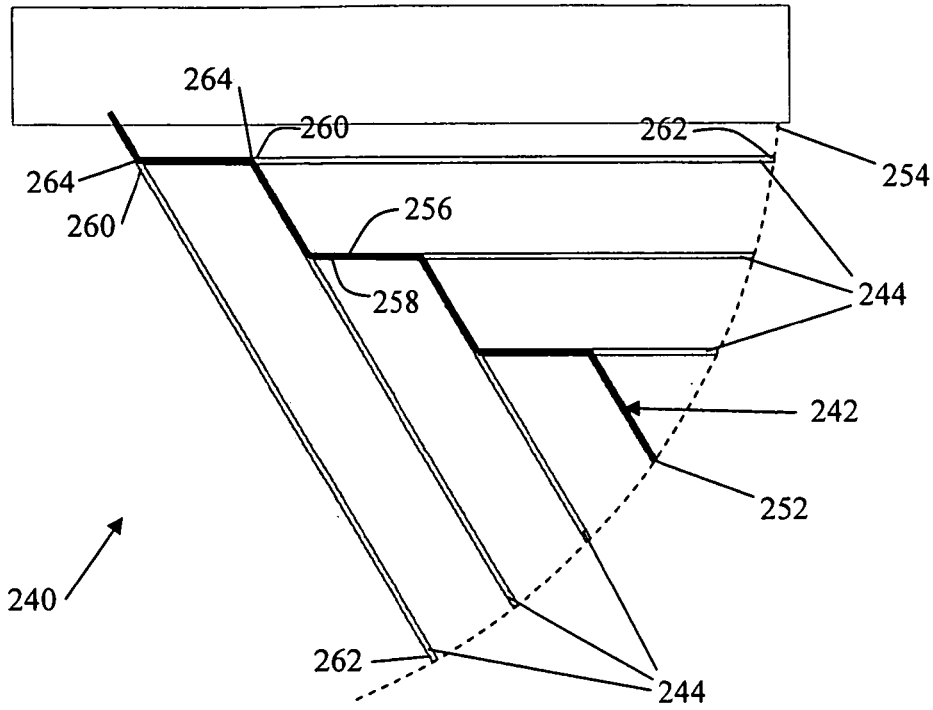
FIG. 11A is a view along an axial direction of a portion of a support structure of the present invention.
Figure 11B:
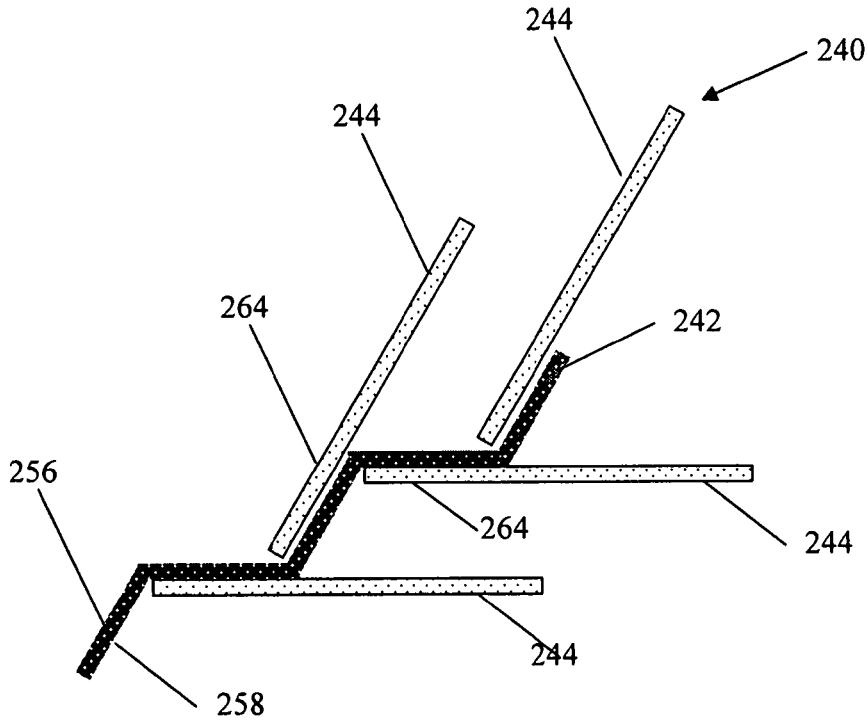
FIG. 11B is a view along an axial direction of a portion of a support structure of the present invention.

Referring now to FIG. 11*a*, there is depicted a branched segment 240 that is a variation of the branched segment 196 described above. The branched segment 240 includes a primary strut 242 and a plurality of secondary struts 244. The primary strut 242 is corrugated and includes a proximal end 246 that is connected to a center or hub (not shown). A distal end 252 of the primary strut 242 extends in a zigzag pattern to a perimeter 254. The primary strut 242 includes a first side 256 and a second side 258. Each secondary strut 244 has a proximal end 260 and a distal end 262. The proximal end 260 is located proximate to the center 248 relative to its distal end 262. The proximal end 260 of each secondary strut 244 is attached to the primary strut 242 at an intersection 264. Each consecutive intersection 264 along the primary strut 242 is equally spaced. Alternatively, as shown in FIG. 11*b*, secondary struts 244 are attached such that intersections 264 are lap joints that may be welded, brazed, bolted, pinned or riveted. Nonetheless, the secondary struts 244 are arranged such that the secondary struts 244 extending from the first side 256 of the primary strut 246 are substantially parallel with respect to each other and the secondary struts 244 extending from the second side 258 are substantially parallel with respect to each other with all of the distal ends 262 extending to the perimeter 254.

Figure 11C:
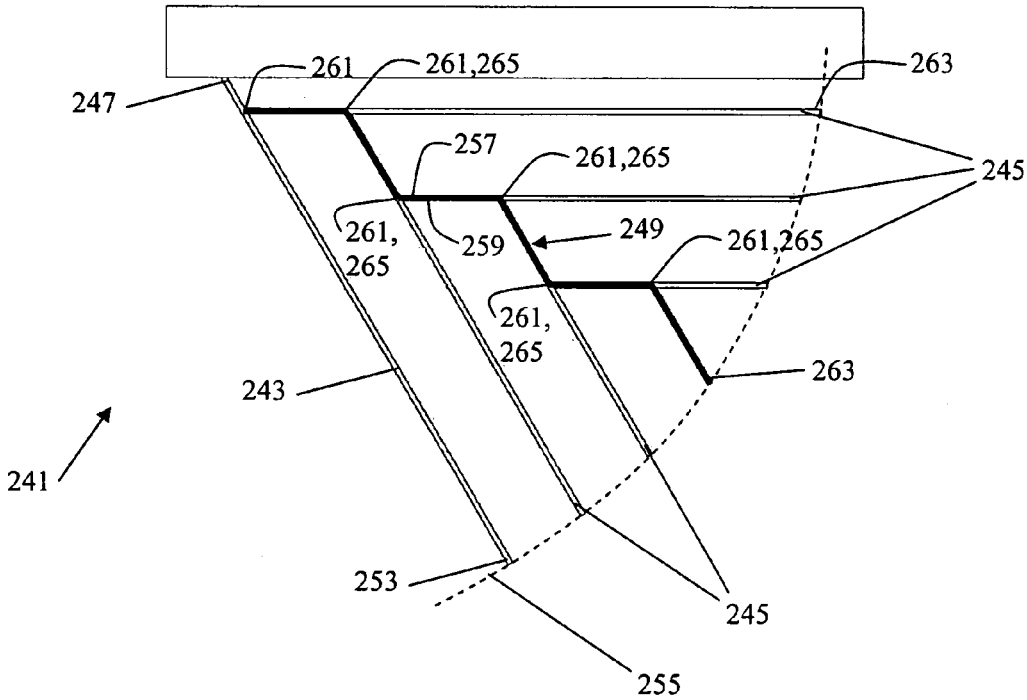
FIG. 11C is a view along an axial direction of a portion of a support structure of the present invention.

Another variation is shown in FIG. 11*c*. This variation illustrates that a secondary strut can be the strut that is corrugated. For example, the branched segment 241 includes a primary strut 243 and a plurality of secondary struts 245. Each secondary strut 245 has a proximal end 261 and a distal end 263. The primary strut 243 is straight and includes a proximal end 247 that is connected to a center or hub (not shown). A distal end 253 of the primary strut 243 extends to a perimeter 255. At least one secondary strut 249 is corrugated (depicted by a solid line) and is shown to be connected to another secondary strut 245, although the invention is not so limited and the corrugated secondary strut may be connected to the primary strut 243. Any variation in which a secondary strut is corrugated is within the scope of this invention. The corrugated secondary strut 249 includes a first side 257 and a second side 259. The proximal end 261 is located proximate to the center (not shown) relative to its distal end 263. The proximal end 261 of each secondary strut 245 is attached to the corrugated secondary strut 249 at an intersection 265. Each consecutive intersection 265 along the corrugated secondary strut 242 is equally spaced, although the invention is not so limited. Also, although FIG. 11*c* shows a corrugated secondary strut 249 having a certain number of bends, the invention is not so limited and the strut 249 can have less or more bends within the scope of the invention. Of course in a another variation, secondary struts 245 are attached such that intersections 265 are lap joints that may be welded, brazed, bolted, pinned or riveted as shown in FIG. 11*b*. Nonetheless, the secondary struts 245 are arranged such that the secondary struts 245 extending from the first side 257 of the corrugated secondary strut 249 are substantially parallel with respect to each other and the secondary struts 245 extending from the second side 259 are substantially parallel with respect to each other with all of the distal ends 263 extending to the perimeter 255.

Figure 12:
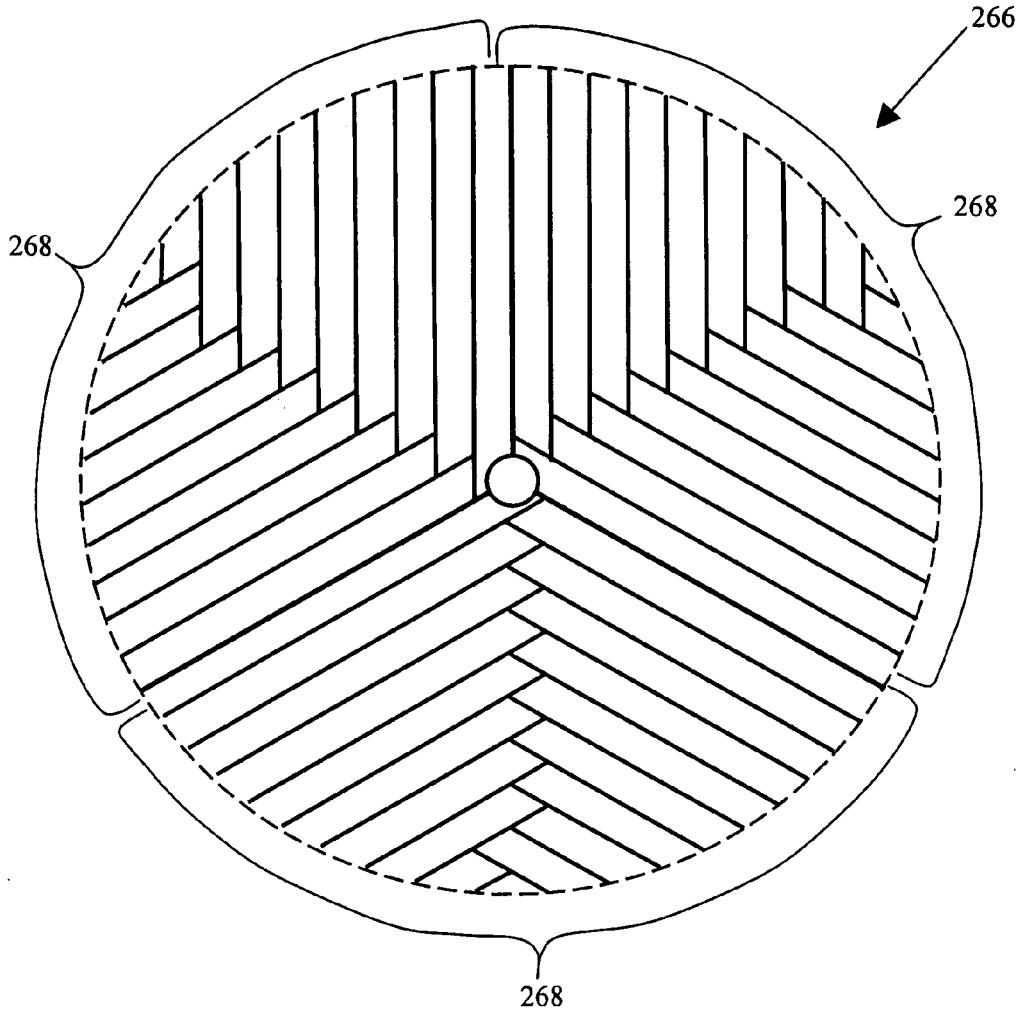
FIG. 12 is a view along an axial direction of a support structure of the present invention.
Figure 13:
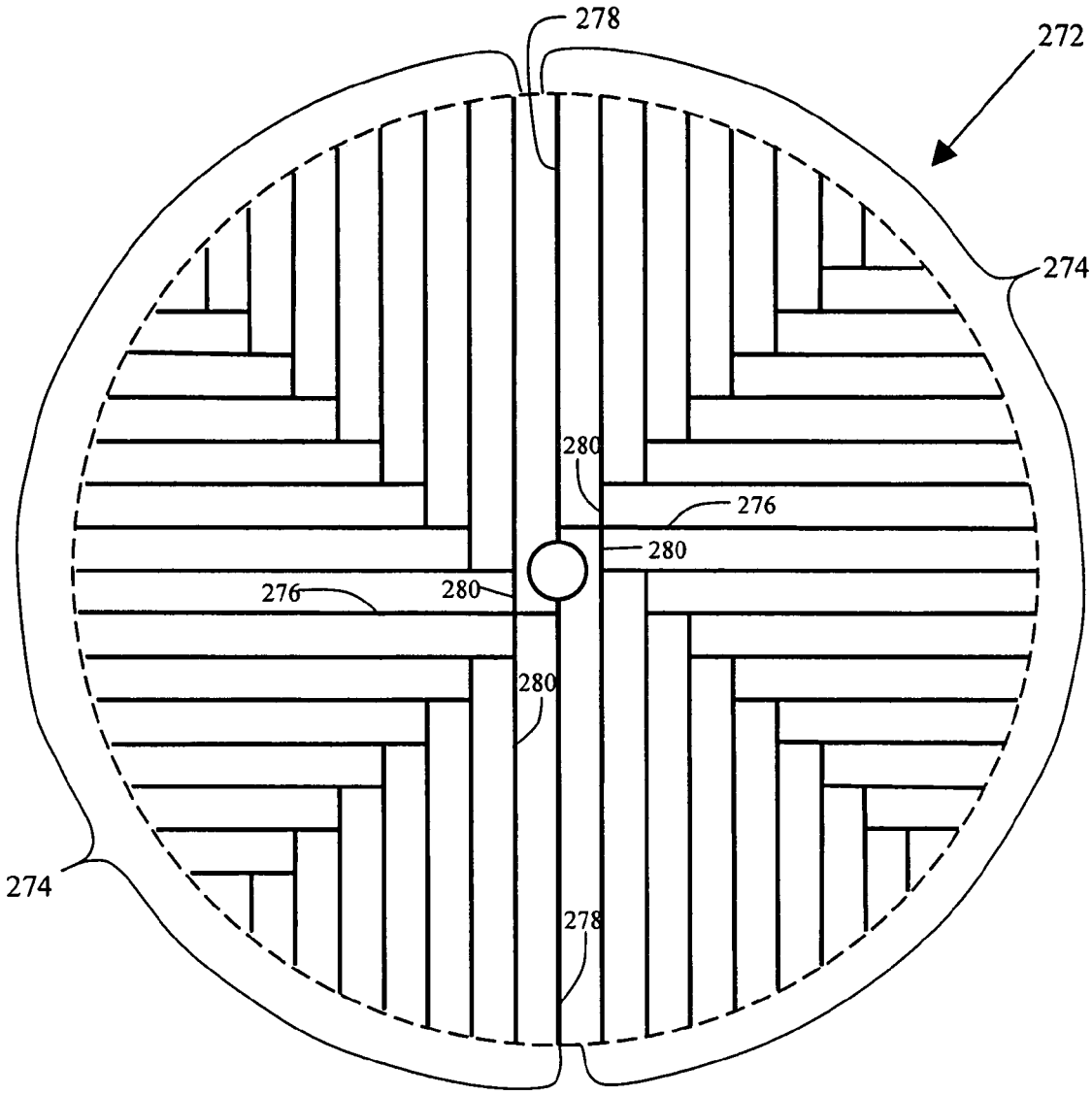
FIG. 13 is a view along an axial direction of a support structure of the present invention.

Although six branched segments are depicted in FIGS. 5 and 6, the invention is not so limited and any number of branched segments are possible especially with an increase in the size of the support structure. For example, in FIG. 12, a support structure 266 having three branched segments 268 is depicted. In FIG. 13, a support structure 272 having two branched segments 274 is depicted. In this variation, a consecutive secondary strut 276 that is attached to a primary strut 278 carries secondary struts 280 on both of its sides. The branched segments 268 and 274 of these variations employ all of the advantages or select combinations thereof described herein.

Figure 14:
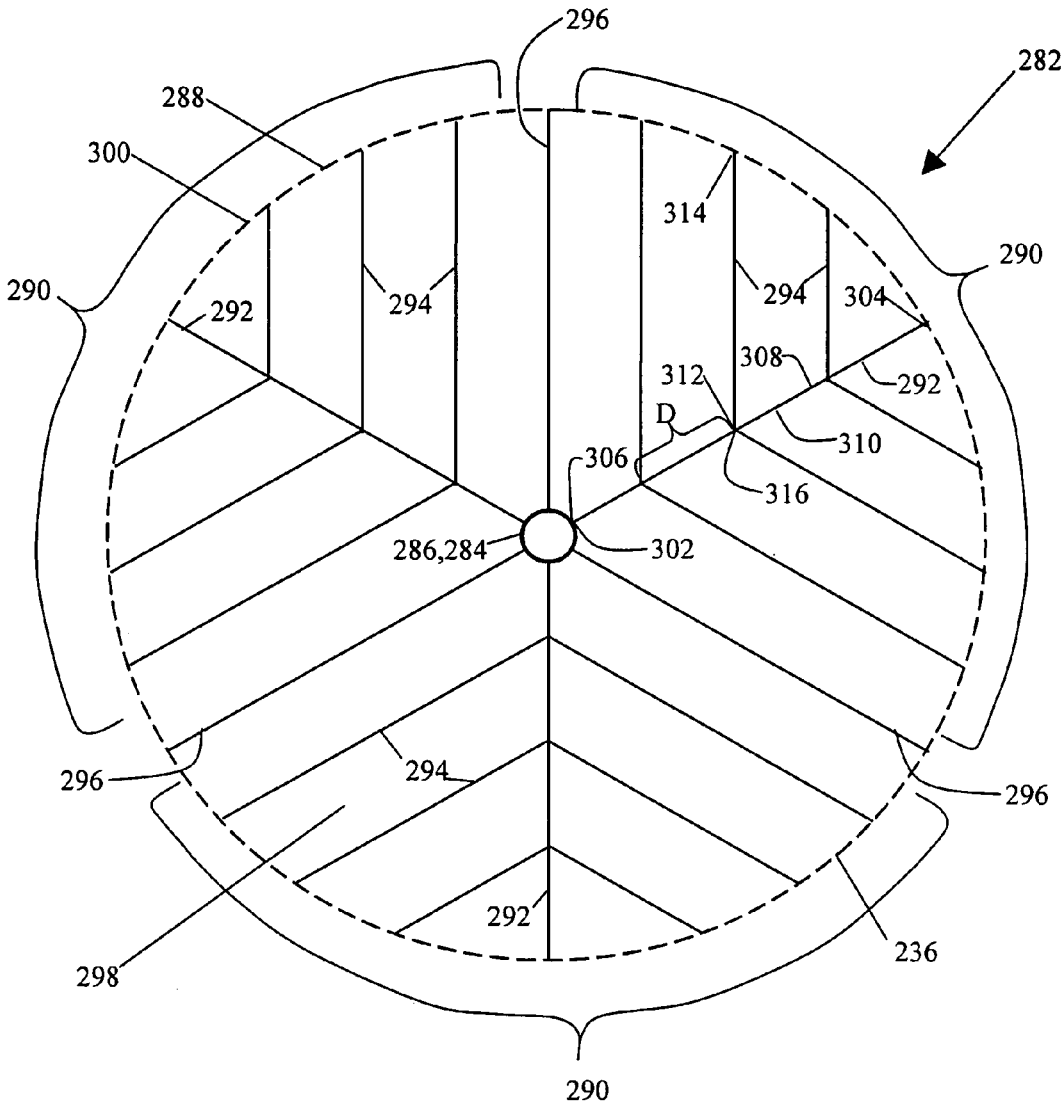
FIG. 14 is a view along an axial direction of a support structure of the present invention.

Referring now to FIG. 14, there is depicted yet another variation of a support structure 282. The support structure 282 includes a center 284 illustrated in FIG. 14 as a hub 286 having a circular cross-section. Of course, the center 284 need not be a hub 286 but may be, for example, a single intersection. In addition, the overall shape of the support structure 282 need not be circular. The center 284 is not necessarily coincident with the geometric center of the support structure. The center is a central intersection or hub 286 that may or may not be at the geometric center of the support structure. The support structure 282 also includes an outer perimeter 288. The support structure 282 further includes three branched segments 290 oriented about the center 284. Each branched segment 290 includes a primary strut 292 and a plurality of secondary struts 294. The support structure 282 also includes three primary struts 296 located between the branched segments 290. Each of the primary struts 296 that are located between the branched segments 290 do not support secondary struts 294 and, as a result, do not form branched segments 290. Although three branched segments 290 and three primary struts 296 that do not support secondary struts 294 are depicted, the invention is not so limited and any operational number of branched segments 290 and primary struts 296 that do not support secondary struts 294 are within the scope of the present invention.

Still referencing FIG. 14, although the perimeter 288 is circular in shape, the invention is not so limited and any shape can be defined by the perimeter 288. The perimeter 236 is selected to coincide substantially with the cross-sectional shape of the combustor (not shown) in which the support structure 282 resides. The perimeter 288 encompasses the arrangement of struts to define an area 298. In one variation, an outer ring 300 is located at the perimeter 288. In such a variation, at least some struts are coupled to the outer ring 300. In addition to welding, bolting, brazing, pinning and riveting struts can be coupled to the outer ring 300 by employing novel constructions described herein.

The arrangement of struts of FIG. 14 will now be described in detail. Each branched segment 290 includes a primary strut 292 and a plurality of secondary struts 294. The primary strut 292 is preferably straight and radial although the invention is not so limited. The primary strut 292 includes a proximal end 302 that is connected to the hub 286 at an intersection 306. A distal end 304 of the primary strut 292 extends to the perimeter 288. Furthermore, the primary strut 292 includes a first side 308 and a second side 310.

Each secondary strut 294 has a proximal end 312 and a distal end 314. The proximal end 312 is located proximate to the center 284 relative to its distal end 314. The proximal end 312 of each secondary strut 294 is attached to the primary strut 292 at an intersection 316. Each consecutive intersection 316 along the primary strut 292 towards the perimeter 288 is spaced at a distance D. In one variation the distance D is constant and in another variation distance D varies. The secondary struts 294 are arranged such that the secondary struts 294 extending from the first side 308 of the primary strut 292 are substantially parallel with respect to each other and the secondary struts 294 extending from the second side 310 are substantially parallel with respect to each other with all of the distal ends 314 of the secondary struts 294 extending to the perimeter 288. The primary struts 296 that are located between the branched segments 290 are positioned such that they are substantially parallel to adjacent secondary struts 294.

Secondary struts 294 are attached to the primary strut 292 in a branched segment 290 by welding, brazing, pinning, bolting or riveting, for example. Alternatively, the primary strut 292 is provided with slots (not shown) extending in an axial direction. The slots are sized to receive a modified secondary strut. The modified secondary strut is modified to have a V-shape. As a result, the modified secondary strut has two distal ends with the apex of the angled modified secondary strut forming an intersection with primary strut when the modified secondary strut is passed through the slot. The slot may be adapted to firmly secure the modified secondary strut without welding or brazing by methods well known in art. This alternative construction is advantageous because the modified secondary strut would be substantially secured yet free enough to expand or contract in response to thermal gradients without creating stress concentrations.

Figure 15:
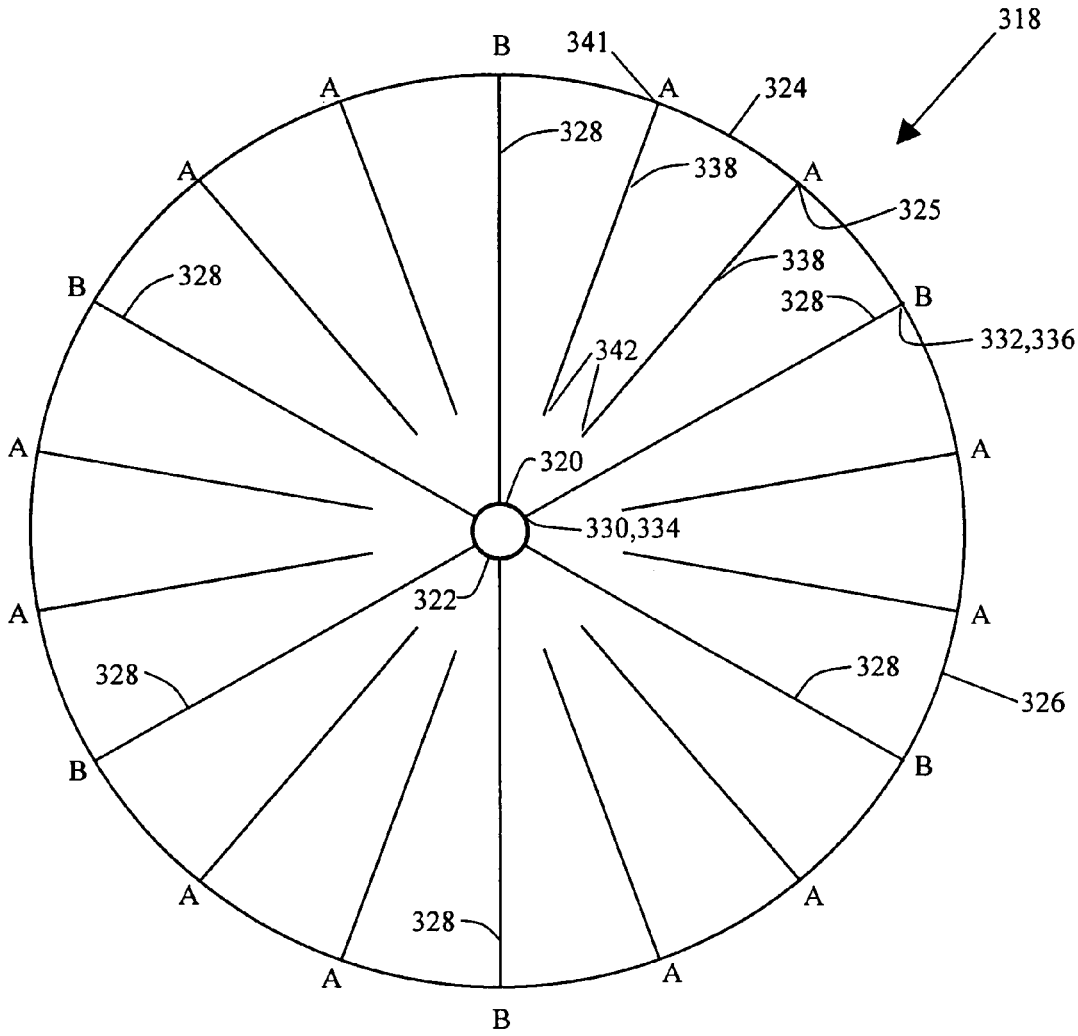
FIG. 15 is a view along an axial direction of a support structure of the present invention.

Referring now to FIG. 15, there is depicted yet another variation of a support structure 318. The support structure 318 includes a center 320 illustrated in FIG. 15 as a hub 322 having a circular cross-section. Of course, the center 320 need not be a hub 322 but may be a single intersection for example. In addition, the overall shape of the support structure 318 may be circular. The center 320 is not necessarily coincident with the geometric center of the support structure. The center is a central intersection or hub that may or may not be at the geometric center of the support structure. The support structure 318 includes an outer ring 324 that defines an outer perimeter 326. The support structure 318 includes six primary struts 328 oriented about the center 320 and designated with the letter B. Each of the primary struts 328 has a proximal end 330 and a distal end 332. The proximal end 330 is proximally located to the center 320 relative to the distal end 332. Each primary strut 328 is connected to the hub 322 at its proximal end 330 forming an intersection 334 and is connected to the outer ring 324 at its distal end 332 to form an intersection 336 with the outer ring 324. The primary strut is preferably radial and can be attached to the hub 322 and outer ring by any combination of welding, brazing, tongue-and-slot or other method described herein or known to a person skilled in the art.

The support structure 318 also includes cantilevered struts 338 designated by the letter A in FIG. 15. As shown, two cantilevered struts 338 are located between primary struts 328, however, the invention is not so limited as long as at least one cantilevered strut 338 is provided between primary struts 328. Each cantilevered strut 338 is connected to the outer ring 324 at a distal end 340 of the cantilevered strut 338 to form an intersection 341, and extends towards the center 320 but a proximal end 342 is not connected to the center 320. Cantilevered struts 338 stop short of intersecting with the hub 322 to prevent over-restricting air flow through the support structure 318 near the center 320 where typically struts are spaced closer together. Cantilevered struts 338 are preferably radial with respect to the center 320 and intersections 336, 341 of the outer ring 324 with both primary 328 and cantilevered struts 338 are equally spaced around the outer ring 324. Although six primary struts 328 and twelve cantilevered struts 338 are depicted, the invention is no so limited and any number is within the scope of the present invention.

Figure 16:
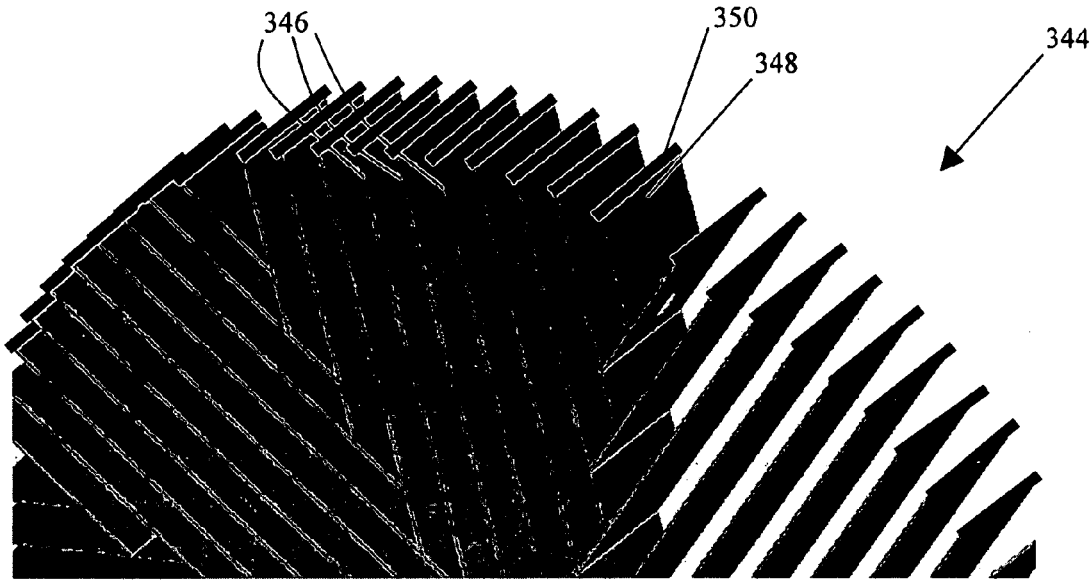
FIG. 16 is a perspective view of a portion of a support structure of the present invention.

The present invention further optionally provides a connection or load transfer arrangement of individual struts of the support structure to the combustor cylinder or outer ring at the support structure perimeter that allows freedom of thermal expansion, the transfer of axial load and secure retention of the strut. This optional aspect of the present invention will now be described in reference to FIGS. 16 and 17. According to one variation, the support structure 344 includes a plurality of struts 346. The struts 346 of the support structure 344 can be configured as described with the exception that each strut 346 has a distal end 348 that includes a flange 350. The flange 350 is integrally formed with the strut 346 or attached thereto to provide a distal end 348 that is substantially T-shaped when viewed along a direction that is perpendicular to the axial direction such that the flange or T-end 350 has a protuberance 352 at each end that extends beyond the width of the strut 346. In one variation, the distal end 348 is also T-shaped when viewed along an axial direction such that the flange 350 or T-end has a protuberance at each end that extends beyond the thickness of the strut 346. The T-end can be the same thickness as the strut 346 or it can be a thicker bar relative to the thickness of the strut 346. The extent of the protuberance at the end of each strut 346 is dependent on the specific design.

Figure 17:
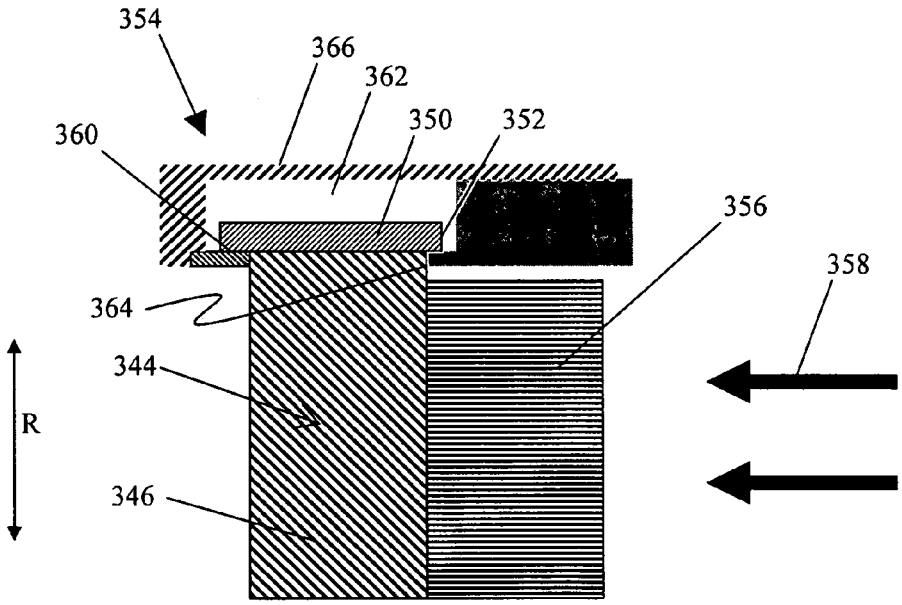
FIG. 17 is a view along a direction perpendicular to an axial direction of a strut outer connection of the present invention.

The support structure 344 is installed in an outer containment 354 holding the catalyst 356 as shown in FIG. 17 which is a sectional view perpendicular to the flow axis taken through the outer end of one of the struts 346. The outer containment 354 has a high velocity gas stream 358 flowing first through the catalyst 356 then through the catalyst support structure 344 consisting of a strut arrangement. The support structure 344 is supported on a ledge 360. The flange 350 of a strut 346 is contained within an expansion slot 362. The strut 346 is free to thermally expand and contract, relative to the outer containment 354, which would drive the strut 346 into the expansion slot 362 along a radial direction R. A further advantage of this aspect of the invention is that, if cyclic fatigue or other failure mode caused the strut 346 to become detached from the other parts of the support structure, the strut 346 cannot fall out of the structure since the flange or T-end 350 will not allow the strut 346 to fall out of the expansion slot 362. The expansion slot 362 is formed by forming a slot in the outer containment 354 or outer ring and then attaching a receiving portion 366. The flange construction at the distal end 348 of strut 346 reduces the possibility of free object damage to other elements, in particular, the turbine located downstream.

Figure 18A:
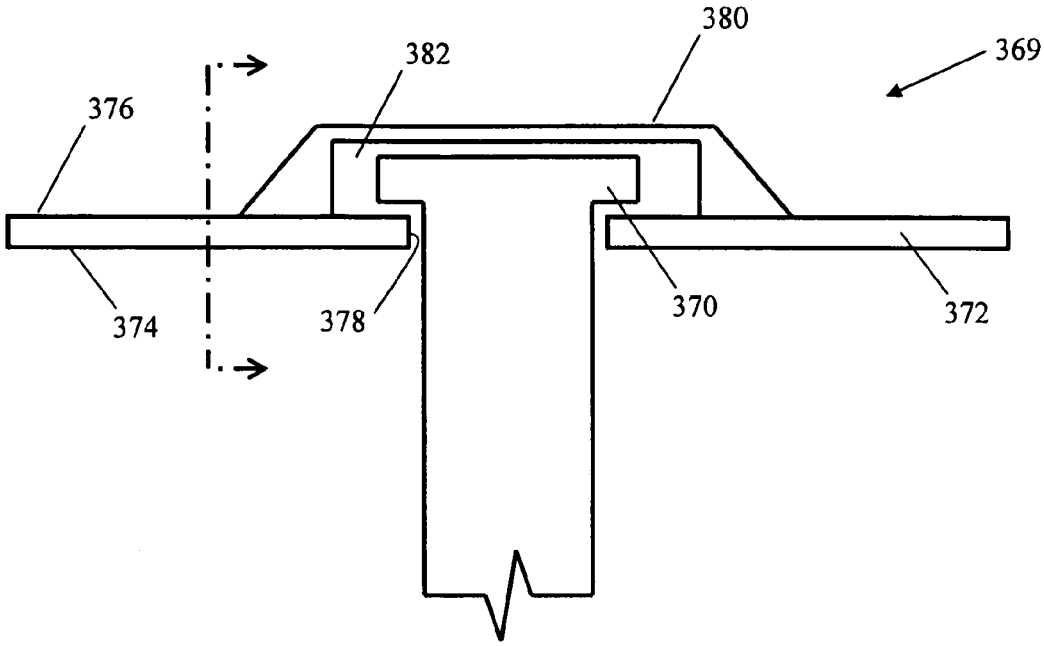
FIG. 18A is a view along a direction perpendicular to an axial direction of a strut outer connection of the present invention.
Figure 18B:
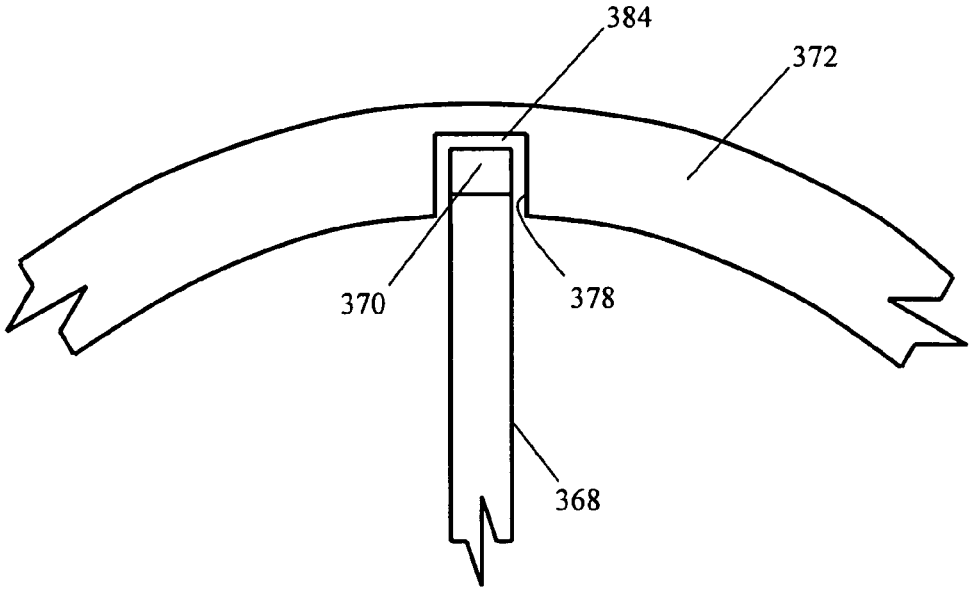
FIG. 18B is a view along an axial direction of a strut outer connection of the present invention.

Another variation of a strut distal end connection is shown in FIGS. 18*a* and 18*b*. In this variation, a strut 368 of a support structure 369 includes a flange 370 or T-end as described above. However, the support structure 369 includes an outer ring 372 and each strut 368 is coupled to the outer ring 372 instead of being directly coupled to the outer containment. The outer ring 372 includes an inner surface 374 and an outer surface 376. An opening 378 is formed in the outer ring 372 and the flange 370 or T-end is passed through the opening 378. A receiving portion 380 is attached at the outer surface 376 to form an expansion slot 382. The strut 368 is retained in the expansion slot 382. A top view of FIG. 18*a* is shown in FIG. 18*b* which illustrates that a gap 384 is provided in the expansion slot 382 to accommodate movement of the strut 368. This variation also advantageously retains the strut 368 and prevents free object damage from occurring.

Figure 19:
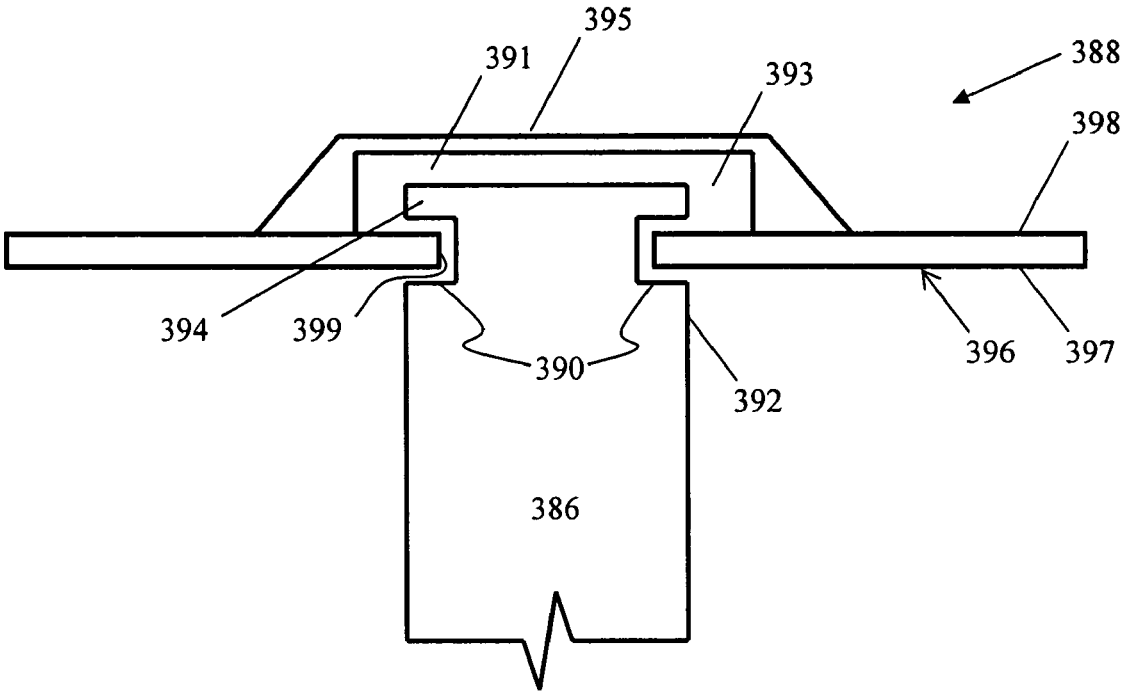
FIG. 19 is a view along a direction perpendicular to an axial direction of a strut outer connection of the present invention.

Another variation of a strut distal end connection is shown in FIG. 19. In this variation, a strut 386 of a support structure 388 includes two notches 390 at a distal end 392 of the strut 386 to form a T-end or flange 394. This strut configuration can be used to connect the strut 386 to either an outer ring 396 or to a outer containment. The outer ring 396 includes an inner surface 397 and an outer surface 398. An opening 399 is formed in the outer ring 396 and the flange 394 or T-end is passed through the opening 399. A receiving portion 395 is attached at the outer surface 398 to form an expansion slot 393 retain the flange 394 therein. A gap 391 is provided in the expansion slot 393 to accommodate movement of the strut 386. This variation also advantageously retains the strut 386 in an axial direction and prevents free object damage from occurring. Similar to the previous variations, the strut 386 of this variation permits substantial free movement and expansion and contraction of the strut 386 in a radial direction relative to the outer containment or the outer ring, provides secure retention should the strut dislocate and is easy to fabricate.

Figure 20A:
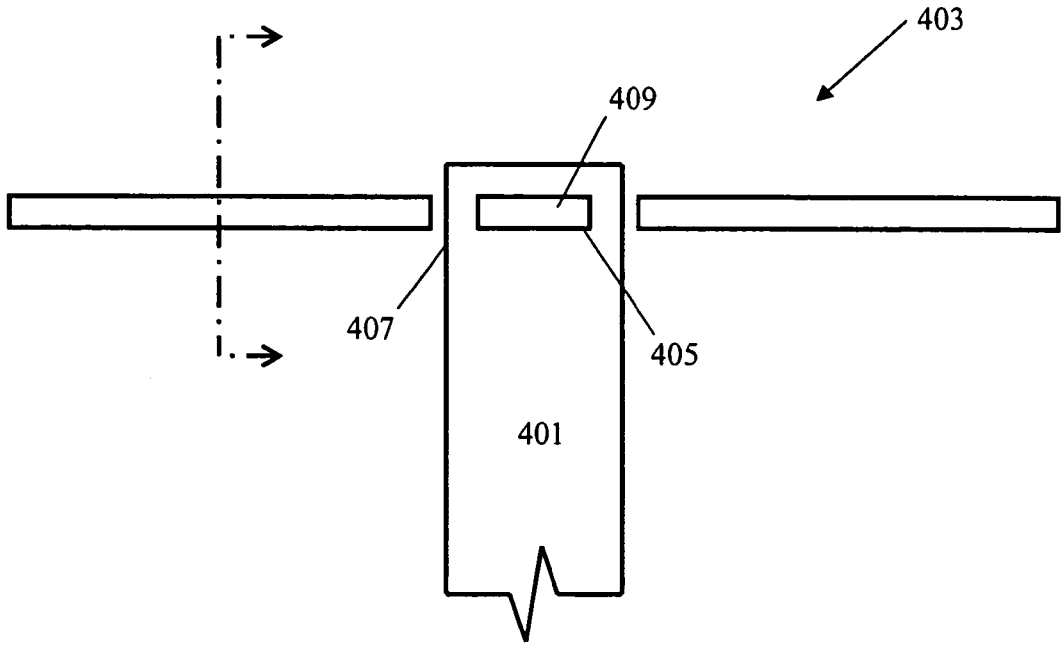
FIG. 20A is a view along a direction perpendicular to an axial direction of a strut outer connection of the present invention.
Figure 20B:
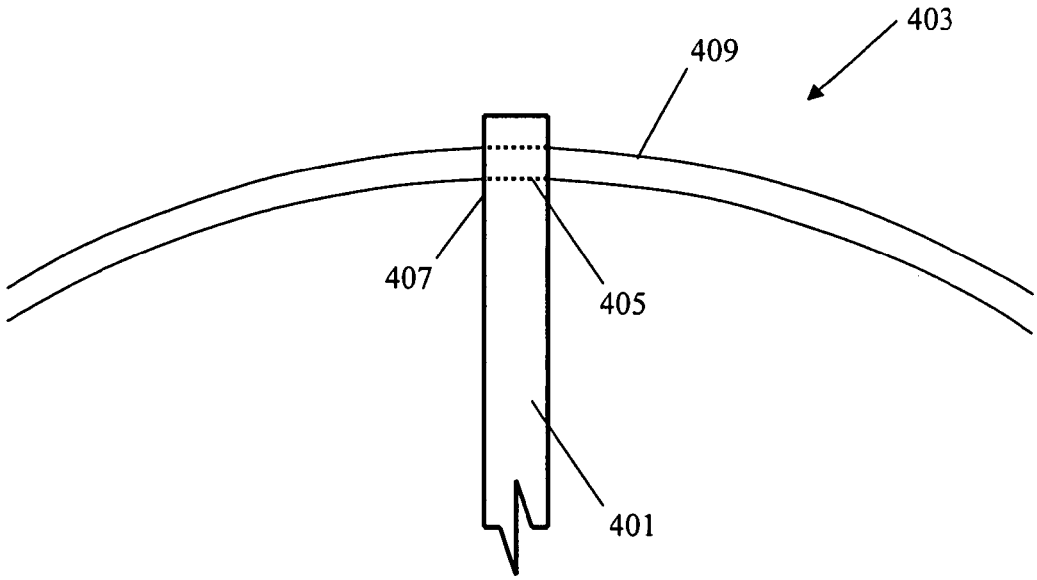
FIG. 20B is a view along an axial direction of a strut outer connection of the present invention.

Another variation of a strut distal end connection is shown in FIGS. 20*a* and 20*b*. In this variation, a strut 401 of a support structure 403 includes at least one slot 405 at a distal end 407 of the strut 401. An outer ring or other member 409 is passed into the slot 405 to retain the strut 401. Although FIGS. 20*a* and 20*b* show a slot that is rectangular in shape, the invention is not so limited. The slot 405 can be of any shape. For example, the slot 405 can be circular to receive a member 409 such as a wire having a circular cross-section. The slot 405 is sized to retain the strut 401. Also, the slot 405 is adapted such that the strut 401 is retained yet substantially free to expand in a radial direction 411 in response to thermal expansion, contraction or other movement. It is clear that the strut 401 can react a load in an axial direction 413.

The materials of construction of the present invention can be iron-based alloys, stainless steels, high strength or super alloys such as alloys of nickel, chromium and cobalt or any combination of these with other materials. Additionally, alloys containing aluminum such as FeCrAl and NiCrAl may be used to provide oxidation resistance. The method of fabrication can be by welding, brazing, bolting, pinning or riveting of each strut at the desired attachment point. Alternatively, the present structure can be machined from a single block of material by any appropriate machining technique including mechanical milling, electrode discharge machining, etc. In addition, the present axial support structure can be cast.

In preferred aspects, struts have a width or dimension in the axial direction of 0.2 to 3.0 inches, preferably 0.4 to 2.75 inches and most preferably from 0.75 to 2.75 inches. The thickness and axial width will be dependent on the axial force to be supported and the other design details to advantageously provide strong support in the axial direction as is desirable for counteracting the axial load from the catalyst. Furthermore, the struts of the present invention have a strut thickness of 0.010 to 0.200 inches, preferably 0.02 to 0.100 inches and most preferably 0.040 to 0.080 inches. For comparison, the material thickness of the material in the prior art honeycomb structure as described in U.S. Pat. No. 6,116,014 to Dalla Betta et al. is typically 0.005 to 0.020 and possibly as large as 0.050. An advantage of the present strut design is that its struts are of increased thickness as compared to a honeycomb design. Oxidation will reduce the thickness of the material over time at the operating temperature by the same amount regardless of thickness. Even small amounts of oxidation could result in a significant weakening of the metal structure. Accordingly, in the case of prior thin support member designs, this loss can represent a significant portion of the thickness whereas the thicker strut of this invention will be less effected or less sensitive to oxidation, thereby, prolonging the life of the support structure.

Additionally, the thicker struts also advantageously provide a structure with a higher tolerance of thermal gradients. The increased strut thickness of the present design is also believed to result in increased creep strength of the metal alloy.

Another advantage of the present invention is its low flow blockage relative to the high amount contact with the catalyst. Also, the present near-radial strut pattern operates very well when contacting a circumferentially wound catalyst. Advantageously, airflow through the present axial support has very low restriction relative to the amount of catalyst foil contact because its approximately radially disposed struts contact the circumferential wound catalyst foils effectively over the entire strut length. This is an advantage over the prior art wherein a substantial portion of the support material does not contact the catalyst foil or contacts the catalyst foil in a highly non-uniform fashion. Moreover, decreased strut spacing does not cause excessive flow blockage near the center relative to the perimeter as would occur for simple radial struts. In sum, a strut arrangement is provided that has low contact stress with the catalyst foils due to the relatively close, uniform contact locations and does not excessively restrict airflow. The strut arrangement incurs a very low disturbance of the gas flow while maintaining a high amount of contact support with the catalyst foils. The present arrangement of axial support structure provides minimal resistance to gas flow and minimal restriction to gas flow through the channels of the catalyst structure.

Figure 2:
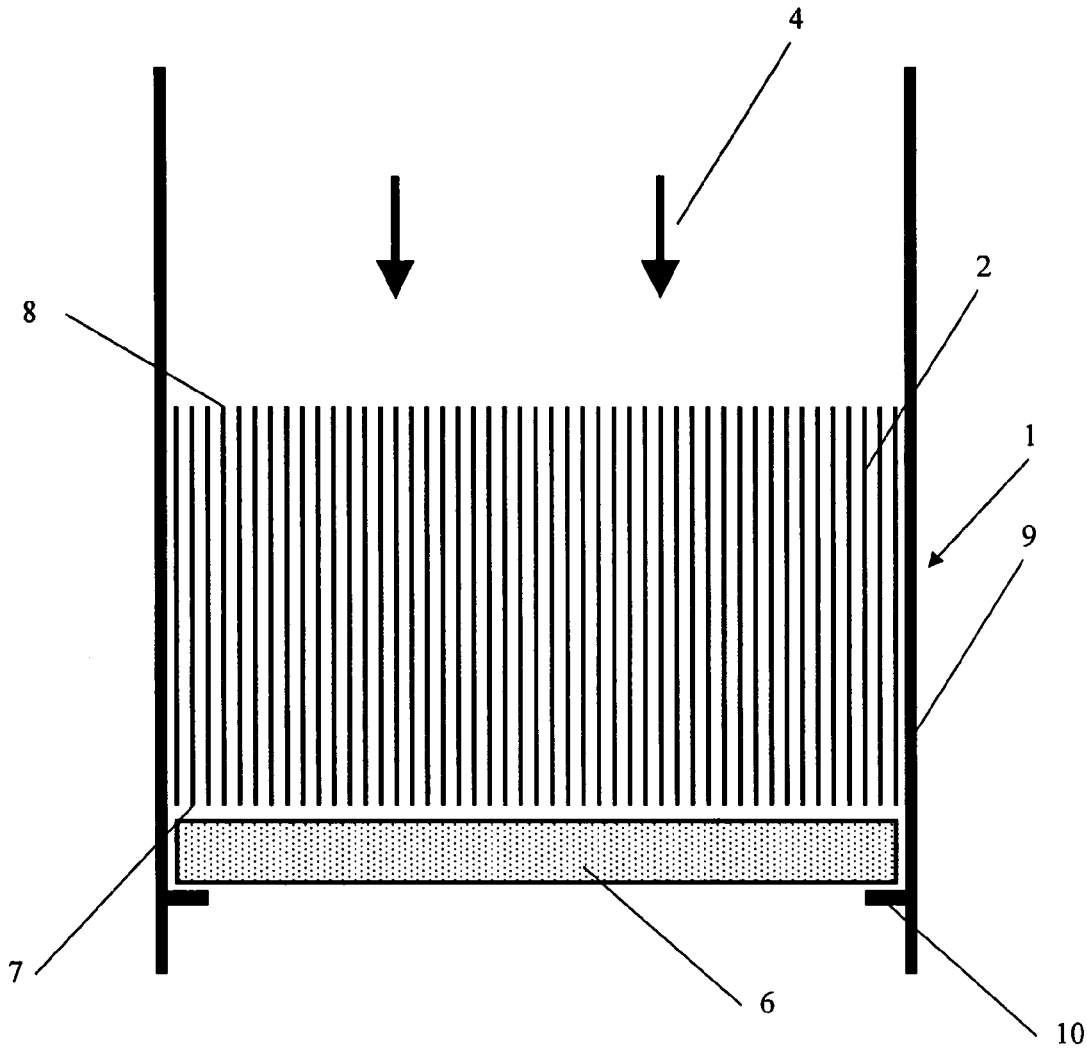
Fig 2 (PRIOR ART)
FIG. 2 is a schematic view of a portion of a catalytic combustion reactor.
Figure 3:
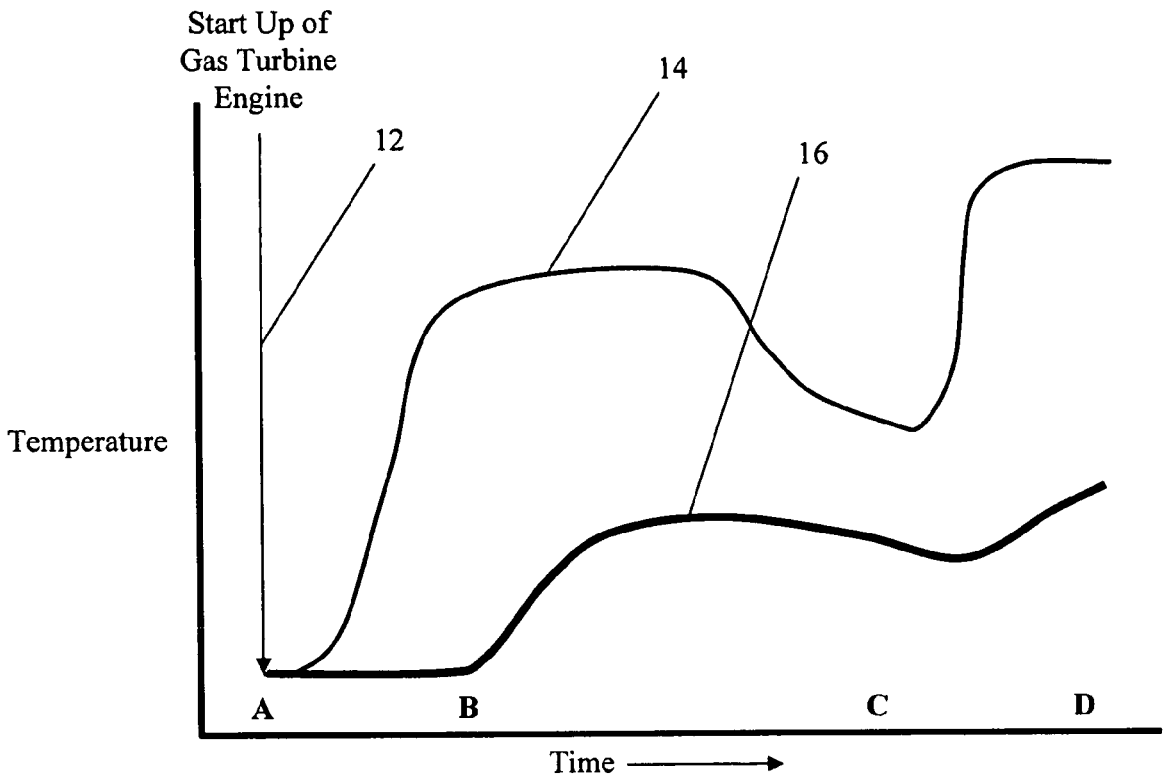
Fig 3 (PRIOR ART)
FIG. 3 is a operating transient illustrating the temperature of a combustion liner wall or chamber and that of the support structure over time.
Figure 4:
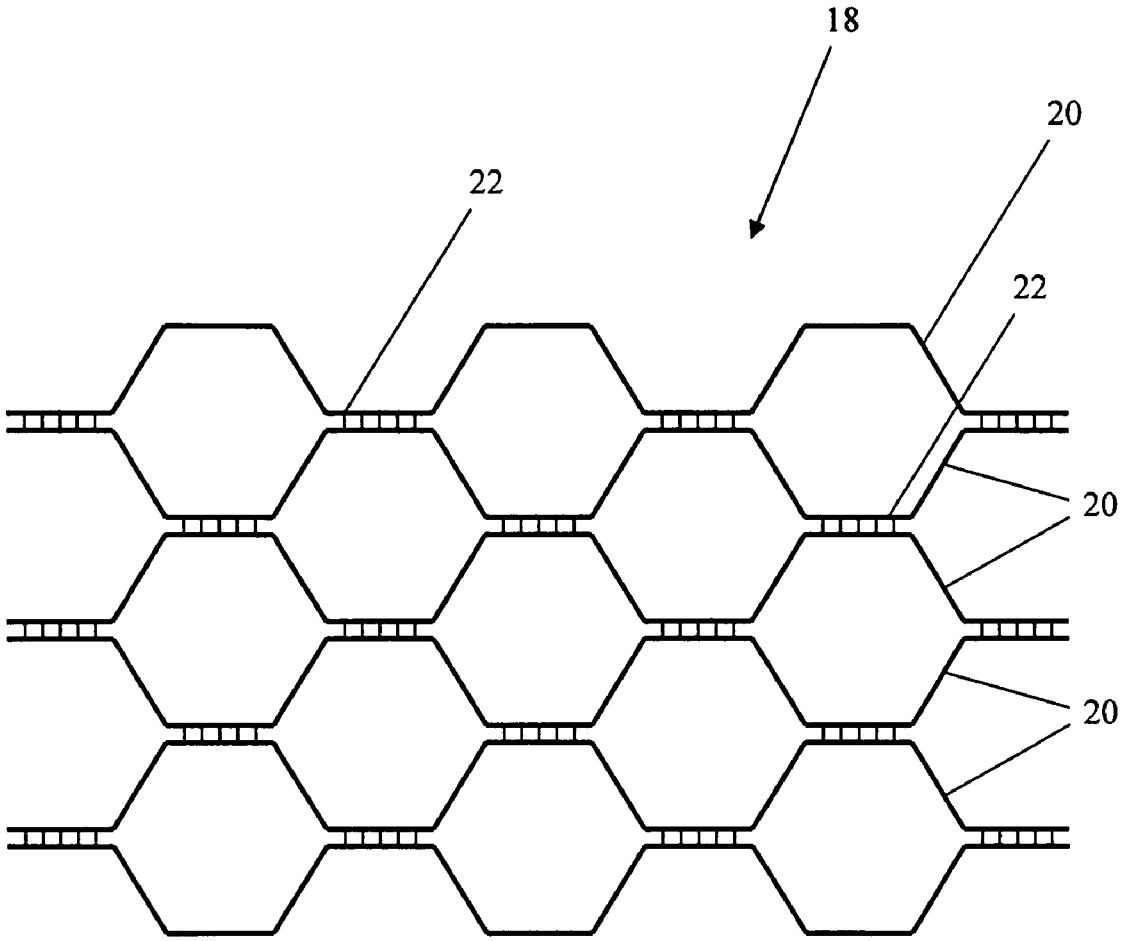
Fig 4 (PRIOR ART)
FIG. 4 is a sectional view of a prior art catalytic reactor support structure along an axial direction.

An advantage of the present design over the honeycomb axial support of the prior art is the lack of thermal stress generated when subjected to non-uniform gas temperatures. The distal end of each strut, as seen in FIG. 2, is supported in the axial (air flow) direction by resting on a ledge 10 or other supporting device in FIG. 5 but is free to move in the radial and circumferential directions. In this manner, each strut is free to thermally expand as required without restriction, thus creating no thermal stress in the strut. This is particularly advantageous since thermal stresses have been shown to result in fatigue (or ratcheting or permanent deformation of the axial support) in existing designs. Both of these durability issues are improved by the present strut configuration.

Improved ability to manufacture a consistent high quality component is another advantage of the present invention. For example, fewer locations requiring joining of material, as compared to existing designs, improves the manufacturabilty. Also, the present design may optionally be produced by casting rather than by fabrication from sub-components. This provides a more consistent and controlled method of manufacturing this type of component and also allows construction from alloys that may have better creep strength.

Figure 21:
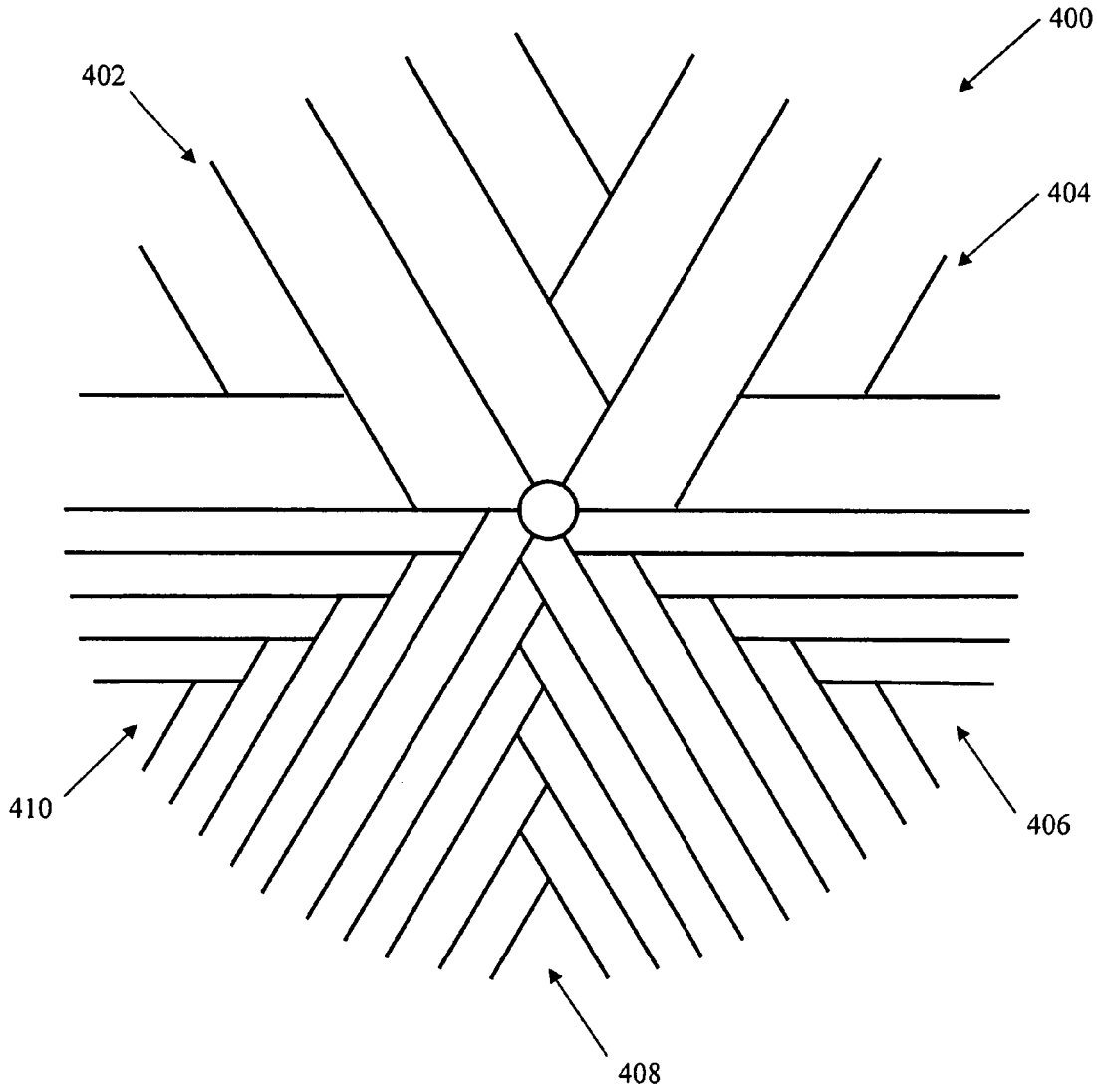
FIG. 21 is a view along an axial direction of a test support structure of the present invention.

A test was conducted in which five different component designs were evaluated. This is referred to as a "rainbow test" because like a rainbow with many different colors, this test evaluated a number of different configurations. The different configurations consisted of five different strut thicknesses with each strut thickness filling a ⅙ th segment of the axial support structure as shown in FIG. 21. Axial support structure 400 was constructed with struts 402 having a thickness of 0.105 inches, struts 404 with a thickness of 0.085 inches, struts 406 with a thickness of 0.063 inches, struts 408 with a thickness of 0.050 inches and struts 410 with a thickness of 0.037 inches. In each case, the strut separation was adjusted to obtain the same contact stress in all sections.

This "rainbow" axial support configuration was installed in a gas turbine combustor with the axial support acting as the support for a catalytic combustion catalyst. After a total exposure of 36 hours at operating conditions and 13 start/stop cycles with 4 full-load trips, one overheat zone was observed through visual observation of the rainbow strut during operation via a thermal imaging camera installed in the gas turbine combustor. This overheat location was correlated with the location of a very thick weld at the joint of two 0.105 inch thick struts. It was determined that the excessively thick joint caused disruption of the flow profile resulting in overheating of the catalyst and the strut. No other damage or signs of overheating was observed either on the axial support after the test or from the thermal imaging camera. Since the rainbow test was designed to cover nominal as well as designs above and below the expected design space, the test did identify the design limits. The conclusion from this test was that the design provided significant advantages, and was specifically well adapted to compensate for thermal stresses.

Figure 22:
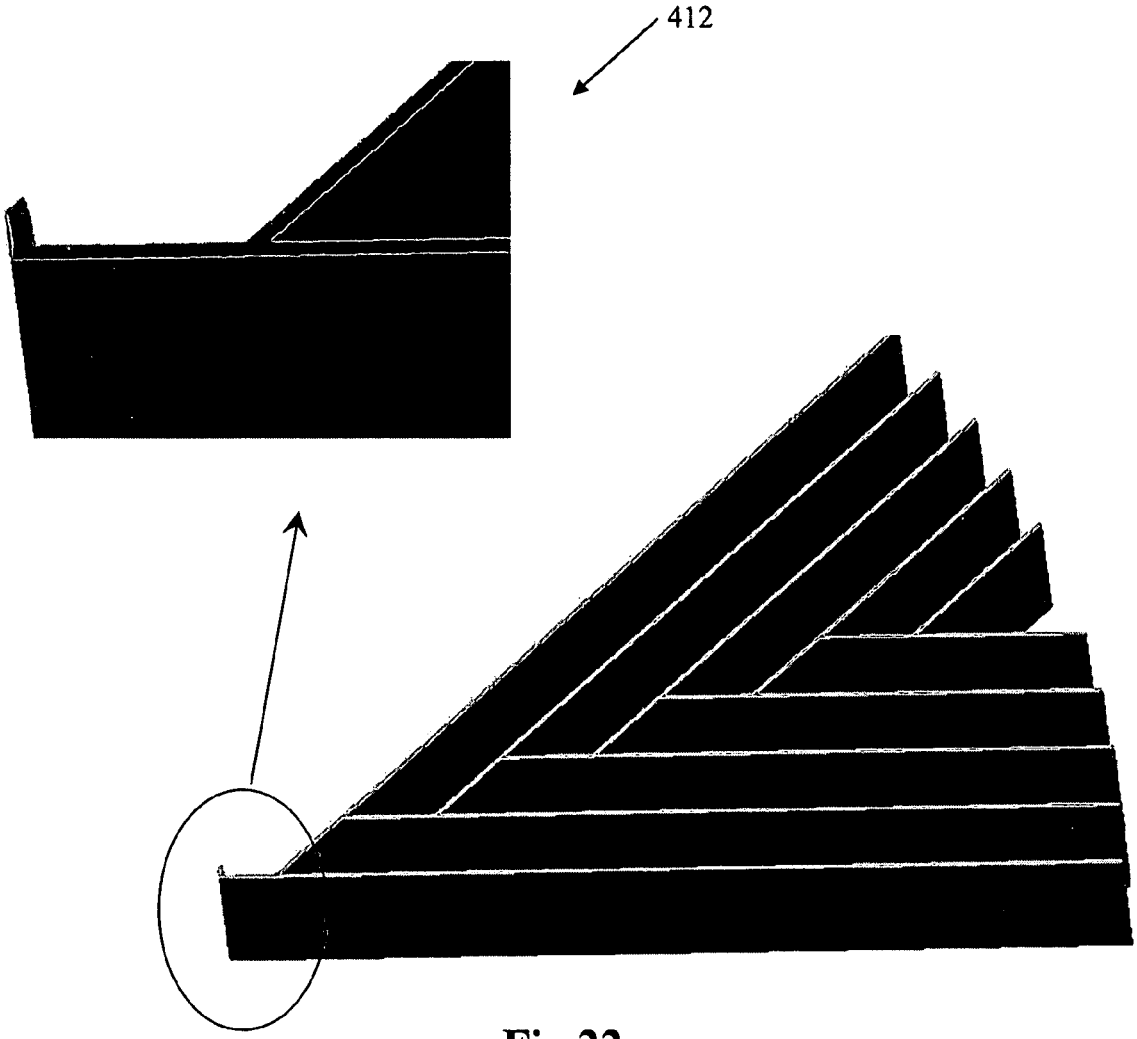
FIG. 22 is a perspective view of a finite element model of a support structure of the present invention.

Finite element analyses and life prediction were employed to further prove the long-term durability of the present strut arrangement design. A finite element model 412 is shown in FIG. 22. This model 412 was used to compute the low cycle fatigue, creep, rupture and buckling stability of the present strut design. The combustor geometry and operating conditions for this assessment were selected as the most difficult potential application. Results of the analyses prove the present system has very good margin of safety for application in a gas turbine combustor. The equivalent stress distribution due to pressure loading was below accepted limits for good durability.

Summarizing the finite element analyses and life prediction it was found that thermal low cycle fatigue life is adequate for much greater than 630 load cycles. At 3.3 times the operating strain range, testing of as-fabricated material measures 630 cycles to crack initiation. Furthermore, fracture initiating from a partial penetration joint does not limit operating life. With only two-third weld penetration in the Y joints, 3,250 cycles are required to grow cracks through the strut thickness. Stress in this structure is approximately one half that which causes rupture in 10,000 hours operation, indicating acceptable rupture margin. Also, creep deflection is estimated to be about 0.21 inches after 8,000 hours and is expected to be less than the previous design. In addition, buckling stability of the long thin struts in bending was analyzed and became unstable at 7 times the operating pressure indicating excellent stability.

Figure 23:
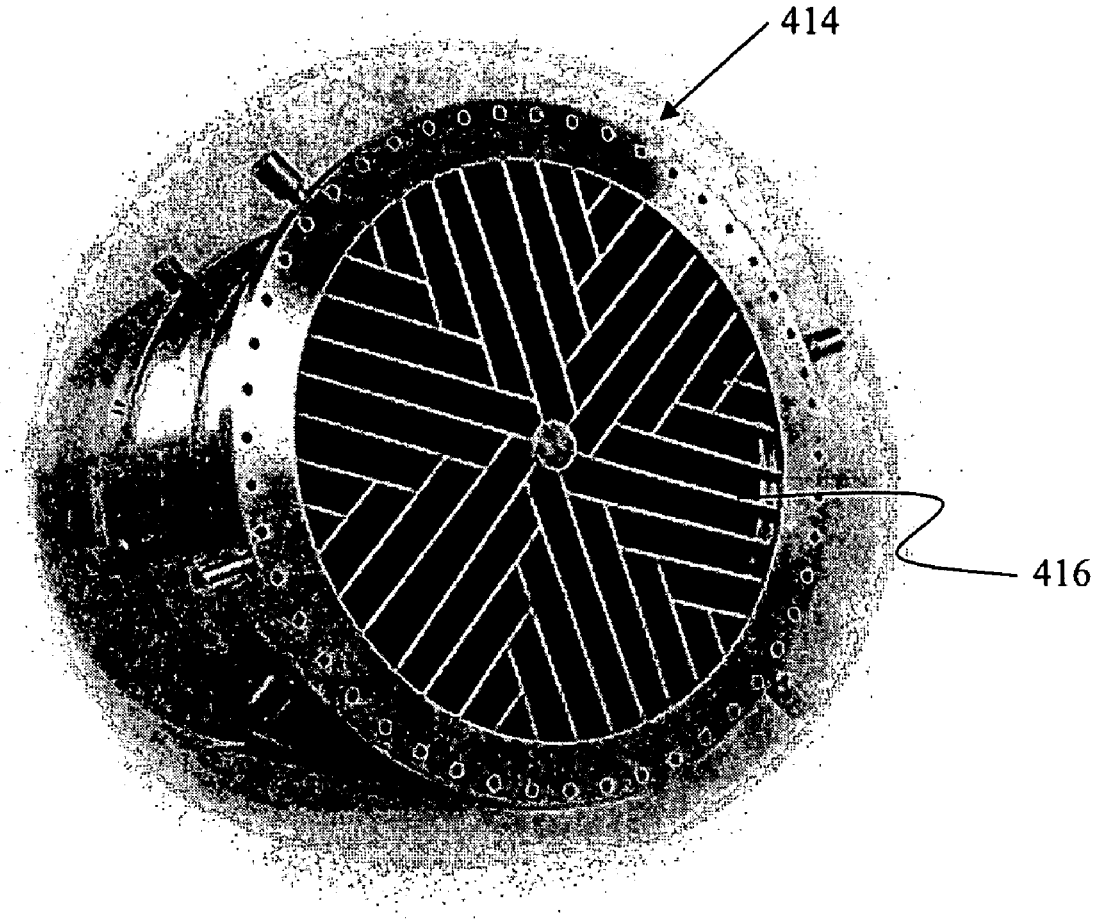
FIG. 23 is a perspective view of a catalytic combustor unit with a support structure of the present invention.

An implementation of the inventive matter is shown in FIG. 23 where a catalytic combustor unit 414 with a present support structure 416 is used to retain the catalyst. The support structure of the present invention can be seen at the outlet of the catalytic combustor unit. As described herein, the present invention provides a number of advantages. In particular, the support structure of the present invention reduces the restriction of air flow through the catalyst, provides uniform support to the catalyst foils, fewer stress concentrations, and struts that are free to expand and contract in response to localized thermal gradients.

What is claimed is:

1. A support structure for supporting a catalyst structure in a catalytic reactor, said support structure having a center and a perimeter and comprising:

a plurality of struts configured to minimally obstruct flow of a gas reaction mixture, wherein said plurality of struts is configured in at least two branched segments radially arranged about the center of the support structure, wherein each branched segment comprises a primary strut with proximal and distal ends, wherein the proximal end of the primary strut is proximal to the center and the distal end extends toward the perimeter, wherein each branched segment further comprises a secondary strut with proximal and distal ends, wherein the proximal end of the secondary strut contacts the primary strut at a position between the proximal and distal ends of the primary strut, and wherein the distal end of the secondary strut extends toward the perimeter, and wherein each branched segment further comprises additional secondary struts with proximal and distal ends, wherein the additional secondary struts alternate in branched fashion in a direction from the center toward the perimeter, wherein the proximal end of each additional secondary strut contacts the previous secondary strut toward the center in the branched segment at a position between the proximal and distal ends of the previous secondary strut and the distal end of each additional secondary strut extends toward the perimeter, wherein the struts are configured such that the struts are free to thermally expand and contract as the temperature changes, and wherein the struts are configured to provide substantially uniform support with respect to a substantial portion of the catalyst structure.

2. The support structure of claim 1 wherein the distance between alternate consecutive secondary struts in a branched segment is substantially constant.

3. The support structure of claim 1 wherein at least one strut of one branched segment is parallel to at least one strut of another branched segment.

4. The support structure of claim 1 wherein the outer perimeter substantially defines a circle.

5. The support structure of claim 1 wherein alternate secondary struts are substantially parallel to each other.

6. The support structure of claim 1 wherein at least one strut includes at least one bend.

7. The support structure of claim 1 wherein at least one strut is straight.

8. The support structure of claim 1 wherein at least one secondary strut includes at least one bend.

9. The support structure of claim 1 wherein each consecutive strut is connected to the previous strut at a variable distance from the proximal end of the previous strut.

10. The support structure of claim 1 wherein each consecutive strut is connected to the previous strut at a constant distance from the proximal end of the previous strut.

11. The support structure of claim 1 wherein at least one strut includes a bend such that its distal end is substantially perpendicular to the perimeter.

12. The support structure of claim 1 wherein the center is located substantially at the center of the perimeter.

13. The support structure of claim 1 wherein the support structure comprises a hub located at the center of the support structure.

14. The support structure of claim 13, further comprising a center spindle attached to the hub.

15. The support structure of claim 14, further comprising a second support structure attached to the center spindle.

16. The support structure of claim 1 wherein at least one strut is corrugated.

17. The support structure of claim 16 wherein the at least one corrugated strut is connected to the center.

18. The support structure of claim 16 wherein the consecutive struts connected to the corrugated strut are connected with lap joints.

19. The support structure of claim 1 wherein the primary struts are connected to the center with slip joints.

20. The support structure of claim 19 wherein the proximal end each primary strut connected to the center includes at least one tongue, and wherein the center includes at least one slot adapted to receive the at least one tongue.

21. The support structure of claim 1 wherein at least one secondary strut is connected to the previous strut with a slip joint.

22. The support structure of claim 21 wherein said previous strut includes at least one slot and the proximal end of said at least one secondary strut includes at least one tongue, wherein a tongue of the at least one secondary strut is received in a slot of the previous strut.

23. The support structure of claim 1 further including an outer ring encompassing the branched segments.

24. The support structure of claim 23 wherein the outer ring includes a plurality of peaks and troughs radially arranged about the outer ring, wherein the distal ends of at least some of the struts are coupled to the outer ring at the troughs.

25. The support structure of claim 23, wherein the distal ends of at least some of the struts are coupled to the outer ring.

26. The support structure of claim 25, wherein at least some of the struts are coupled to the outer ring with a slip joint.

27. The support structure of claim 1 wherein the distal end of at least one strut includes a flange.

28. The support structure of claim 27 further including an outer ring having an expansion slot, wherein the flange is received within the expansion slot such that the at least one strut is retained yet substantially free to move in a radial direction within the expansion slot.

29. The support structure of claim 1 wherein the distal end of at least one strut includes at least two notches to form a T-end.

30. The support structure of claim 29 further including an outer ring having an expansion slot, wherein the T-end is received within the expansion slot such that the strut is retained yet substantially free to move in a radial direction within the expansion slot.

31. The support structure of claim 1 wherein the distal end of at least one strut includes a slot.

32. The support structure of claim 31 further including an outer ring passed through the slot such that the distal end is retained yet substantially free to move in a radial direction.

33. The support structure of claim 1 wherein at least one strut is connected to the center with at least a braze lug.

34. The support structure of claim 1 wherein at least one secondary strut is connected to the previous strut with at least a braze lug.

35. The support structure of claim 33 or 34 wherein the braze lug includes at least two flanges, a strut receiving portion coupled to the at least two flanges, at least two tabs coupled to the at least two flanges, and at least one tab coupled to the strut receiving portion.

36. The support structure of claim 1 wherein at least a portion of the distal ends of said plurality of struts are connected to an outer ring.

37. The support structure of claim 36 wherein the at least a portion of the distal ends are connected to the outer ring with a slip joint.

38. The support structure of claim 1 wherein at least a portion of each of the distal ends of said plurality of struts includes a flange.

39. The support structure of claim 38, further comprising an outer ring comprising expansion slots, wherein the flanges are received within the expansion slots such that they are retained yet substantially free to move in a radial direction within the expansion slots.

40. The support structure of claim 1 wherein at least a portion of each of the distal T-ends of said plurality of struts includes at least two notches to form a end.

41. The support structure of claim 40, further comprising an outer ring comprising expansion slots, wherein the T-ends are received within the expansion slots such that they are retained yet substantially free to move in a radial direction within the expansion slots.

42. A support structure according to claim 14, wherein said center spindle transfers an axial load upstream to a second support structure.

* * * * *